US005476758A

United States Patent [19]

Suga et al.

[11] Patent Number: 5,476,758

[45] Date of Patent: Dec. 19, 1995

[54] SILVER HALIDE COLOR PHOTOGRAPHIC LIGHT-SENSITIVE MATERIAL

[75] Inventors: Yoichi Suga; Masaki Okazaki, both of Minami-Ashigara, Japan

[73] Assignee: Fuji Photo Film Co., Ltd., Minami-Ashigara, Japan

[21] Appl. No.: 254,430

[22] Filed: Jun. 6, 1994

Related U.S. Application Data

[63] Continuation of Ser. No. 883,125, May 14, 1992, abandoned.

[30] Foreign Application Priority Data

May 17, 1991 [JP] Japan ..... 3-140652

[51] Int. Cl.[6] ..... G03C 1/46

[52] U.S. Cl. ..... 430/503; 430/553; 430/570; 430/581; 430/583; 430/585; 430/587; 430/588

[58] Field of Search ..... 430/503, 533, 430/570, 581, 583, 585, 587, 588

[56] References Cited

U.S. PATENT DOCUMENTS 4,946,767 8/1990 Yamagami ..... 430/503
5,096,804 3/1992 Ikenoue et al. ..... 430/503

*Primary Examiner*—Charles L. Bowers, Jr.
*Assistant Examiner*—Geraldine Letscher
*Attorney, Agent, or Firm*—Birch, Stewart, Kolasch & Birch

[57] ABSTRACT

Disclosed herein is a silver halide color photographic light-sensitive material which has a specific photographic sensitivity of 320 or more, and which comprises a support layer and silver halide emulsion layers formed thereon. The material has a film thickness of 22 μm or less, measured from the light-sensitive layer closest to the support layer up to the surface of the material facing away from the support layer. At least one of the silver halide emulsion layers contains a spectral sensitizer represented by the following formula (I):

Formula (I)

In the formula, $R^1$ and $R^2$ are alkyl groups, at least one of which at least one carbon atom bonds together with at least three atoms other than hydrogen atoms, X is an anion, p is 0 or 1, k is 0, 1 or 2, $L_1$ and $L_2$ are a methyne group or a substituted methyne group, $Z^1$ and $Z^2$ are groups of atoms numerous enough to form a 5- or 6-membered nitrogen-containing heterocyclic ring.

19 Claims, No Drawings

SILVER HALIDE COLOR PHOTOGRAPHIC LIGHT-SENSITIVE MATERIAL

This application is a continuation of application Ser. No. 07/883,125 filed on May 14, 1992, now abandoned.

BACKGROUND OF THE INVENTION

1. Field of the Invention

The present invention relates to a silver halide color photographic light-sensitive material. More particularly, it relates to a silver halide color photographic light-sensitive material which has a film thickness of 22 μm or less, measured from the silver halide light-sensitive layer closest to the support layer up to the surface of the material facing away from the support layer, which has a protective film having a thickness of 3 μm or less, or which contains a limited amount of an organic solvent having a high boiling point, and which exhibits improved sharpness and improved pressure resistance.

2. Description of the Related Art

In order to enhance the sensitivities of light-sensitive materials, many efforts have been exerted hitherto. Many studies have been made of methods of preparing silver halide grains having desirable shapes and compositions, of chemical sensitization and spectral sensitization, and of additives and structures of couplers which can be used. Some of these studies have matured into useful inventions. These inventions, however, can no longer meet the demand for highly light-sensitive material which has grown stronger still.

In the art it is customarily practiced to use silver halide grains, as large as possible, in each light-sensitive emulsion layer and to apply other techniques, thereby to enhance the light-sensitivity of the material. If silver halide grains having a large size are used, the light-sensitivity increases indeed, but to some extent only, as long as the amount of silver halide used is limited. This is because, the larger the grains, the less grains the light-sensitive emulsion layer contains. Hence, the number of development-starting points is decreased, and the graininess is impaired.

Therefore, to meet the demand for high sensitivity and high image quality, as large amount of silver halide grains as possible were used in each light-sensitive emulsion layer, thus increasing the number of development-starting points. It is a general design guide that the more silver halide grains that the layer contains, the thicker the layer. The thicker the layer, however, the less sharpness the light-sensitive material will have, thus failing to meet the recently made demand for high image quality. The sharpness may be improved if the light-sensitive layer, as well as a protective layer, is made thinner. The light-sensitive layer cannot be so thin, however. If it is too thin, the material cannot have a sufficient pressure resistance, increasing the possibility that "friction fogging" occurs as a photographic film having the light-sensitive layer is wound up in cameras at high speed or fed at high speed in the developing process.

Data on out-of-focus ratio of ISO100 film and that of ISO400 film is disclosed in JP-A-63-236035 (JP-A means "Published Unexamined Japanese Patent Application"). The data teaches that ISO400 film results in a lower out-of-focus ratio, indicating that people have the tendency of setting the diaphragm at smaller apertures when they use ISO400 film than when they use ISO100 film. Obviously, high-sensitive photographic film is greatly desirable.

SUMMARY OF THE INVENTION

An object of the present invention is to provide a silver halide color photographic light-sensitive material which has excellent sharpness, high image-quality, and high light-sensitivity.

Another object of the present invention is to provide a silver halide color photographic light-sensitive material which excels in pressure resistance.

A further object of the present invention is to provide a silver halide color photographic light-sensitive material which hardly has friction fog and has good sharpness and high light-sensitivity.

A still further object of the present invention is to provide a silver halide color photographic light-sensitive material which contains a cyan coupler emulsified and dispersed in only an organic solvent having a high boiling point, which excels in pressure resistance, and which can form high-quality cyan images.

The inventors of the present invention have conducted research and studies, successfully achieving the objects of the present inventions, described above.

In a first aspect of the invention, there is provided a silver halide color photographic light-sensitive material which comprises a support layer, and silver halide emulsion layers formed on the support layer, one upon or above another, including at least one red-sensitive layer, at least one green-sensitive layer, and at least one blue-sensitive layer, and which has a specific photographic sensitivity of 320 or more. The material is characterized in that at least one of the silver halide emulsion layers containing a spectral sensitizer represented by the following formula (I), and that it has a film thickness of 22 μm or less, measured from the light-sensitive layer closest to the support layer up to the surface of the material facing away from the support layer.

(I)

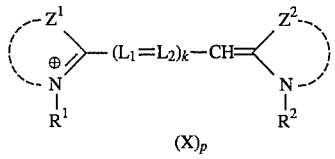

Formula (I)

In the formula (I), X is an anion, $R^1$ and $R^2$ are alkyl groups. In at least one of these alkyl groups, at least one carbon atom bonds with at least three atoms other than hydrogen atoms. In the formula (I), $Z^1$ and $Z^2$ are groups of atoms forming a 5- or 6-membered nitrogen-containing heterocyclic ring.

In a second aspect of the invention, there is provided a silver halide color photographic light-sensitive material which comprises a support layer, and silver halide emulsion layers formed on the support layer, one upon or above another, including at least one red-sensitive layer, at least one green-sensitive layer, and at least one blue-sensitive layer, and which has a specific photographic sensitivity of 320 or more. The material is characterized in that at least one of the silver halide emulsion layers represented by the above-specified formula (I), and that it has a protective layer having a thickness of 3 μm or less which is located farther from the support layer than the light-sensitive layer located farther from the support layer than any other light-sensitive layer.

In a third aspect of this invention, there is provided a silver halide color photographic light-sensitive material identical to the material according to the second aspect of the invention, except tabular grains having an aspect ratio of at least 3 occupy 50% or more of the total projected area of all silver halide grains contained in said at least one blue-sensitive layer.

In a fourth aspect of the present invention, there is provided a silver halide color photographic light-sensitive material which comprises a support layer, and silver halide emulsion layers formed on the support layer, one upon or above another, including at least one layer containing cyan couplers, at least one layer containing magenta couplers, and at least one layer containing yellow couplers. The material is characterized in that the layer containing cyan couplers also contains a spectral sensitizer represented by the formula (I), that at least one of the cyan couplers is one represented by the following formula (II), and that the layer containing the cyan couplers also contains an organic solvent having a high boiling point, whose weight ratio is 0.3 at most to all cyan couplers used.

General formula (II)

Formula (II)

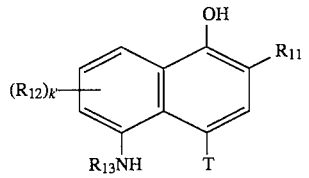

In the formula (II), $R_{11}$ is a halogen atom, aliphatic group, aromatic group, a heterocyclic group, amidino group, a guanidino group, or a group represented by $—CO_2R_{14}$, $—SO_2R_{14}$, $—SOR_{14}$, $—P(=O)R_{14}R_{15}$, $—NHCOR_{14}$, $—NHSO_2R_{14}$, $—NHSOR_{14}$ or $—NHP(=O)R_{14}R_{15}$. $R_{12}$ is a halogen atom, a hydoxyl group, a carboxyl group, sulfo group, amino group, cyano group, nitro group, aliphatic group, aromatic group, carbonamide group, sulfonamide group, carbamoyl group, sulfamoly group, ureido group, acyl group, acyloxy group, aliphatic oxy group, aromatic oxy group, aliphatic sulfonyl group, aromatic sulfonyl group, aliphatic sulfinyl group, aromatic sulfinyl group, aliphatic oxycarbonyl group, aromatic oxycarbonyl group, aliphatic oxycarbonylamino group, aromatic oxycarbonylamino group, sulfamoylamino group, heterocyclic group, or imido group. In the formula (II), k' is an integer ranging from 0 to 3, and $R_{13}$ is a hydrogen atom or $R_{16}U$. T is a hydrogen atom or a group which can be released when it undergoes coupling reaction with an aromatic primary amine developing oxide. $R_{14}$ and $R_{15}$ are each independently aliphatic group, aromatic group, heterocyclic group, amino group, aliphatic oxy group, or aromatic oxy group. $R_{16}$ is a hydrogen atom, aliphatic group, aromatic group, heterocyclic group, $—OR_{17}$, $—SR_{17}$, $—COR_{18}$, $ON(R19)(R_{20})$, $—PO(R_{17})_2$, $—PO(—OP_{17})_2$, $—PO(—N(R_{19})(R_{20}))_2$, $—SO_2N(R_{19})(R_{20})$, $—CO_2R_{17}$, $—SO_2R_{17}$, $—SO_2OR_{17}$, or imido group. U is $—N(R_{10})—$, —CO—, $—SO_2—$, —SO—, or a single bond. $R_{17}$ is aliphatic group, aromatic group or heterocyclic group. $R_{18}$ is a hydrogen atom, aliphatic group, aromatic group or heterocyclic group. $R_{19}$ and $R_{10}$ are each independently a hydrogen atom, aliphatic group, aromatic group, hetero cyclic group, acyl group, aliphatic sulfonyl group, or aromatic sulfonyl group. In the formula (II), when k' is 2 or greater, groups $R_{12}$ can be identical or different, or can bond together, forming a ring. $R_{12}$ and $R_{13}$, or $R_{13}$ and T can bond together, forming a ring. Further, at $R_{11}$, $R_{12}$, $R_{13}$, or T, dimers or polymers (including oligomers) can be formed which are attached to one another through bivalent or polyvalent groups.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

DETAILED DESCRIPTION OF THE PREFERRED EMBODIMENTS

The present invention will be described in greater detail. First, the compound of the formula (I), i.e., the spectral sensitizer, will be explained.

Formula (I)

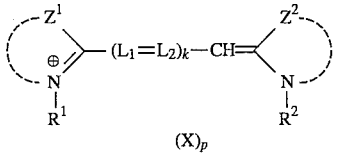

In the formula (I), $R^1$ and $R^2$ are alkyl groups, either substituted or unsubstituted, having 1 to 18 carbon atoms, preferably 1 to 7 carbon atoms, and more preferably 1 to 4 carbon atoms. Examples of the unsubstituted alkyl group are: methyl, ethyl, propyl, isopropyl, butyl, isobutyl, hexyl, octyl, dodecyl, and octadecyl. Examples of the substituted alkyl group are: aralkyl group (e.g., benzyl or 2-phenylethyl), hydroxyalkyl group (e.g., 2-hydroxyethyl or 3-hydroxypropyl), carboxyalkyl group (e.g., 2-carboxyethyl, 3-carboxypropyl, 4-caroxybutyl, or carboxymethyl), alkoxyalkyl group (e.g., 2-methoxyethyl or 2-(2-methoxyethoxy) ethyl), sulfoalkyl group (e.g., 2-sulfo ethyl, 3-sulfopropyl, 3-sulfobutyl, 4-sulfobutyl, 2-(3-sulfopropoxy) ethyl, 2-hydroxy-3-sulfopropyl, or 3-sulfopropoxy ethoxyethyl), sulfatoalkyl group (e.g., 3-sulfatopropyl or 4-sulfatobutyl), heterocyclic substituted alkyl group (e.g., 2-(pyrrolidine-2-on-1-yl) ethyl, or teterahydro furfurlyl), 2-acetoxyethyl group, carbomethoxymethyl, 2-methanesulfonyl aminoethyl, and aryl group.

In at least one of the alkyl groups $R^1$ or $R^2$, or preferably both alkyl groups, at least one carbon atom bonds together with at least three atoms other than hydrogen atoms. At least one of these alkyl groups $R_1$ and $R^2$ has organic acid, and is identified by the following formula (III):

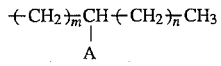

wherein A is an organic acid group, m is an integer ranging from 0 to 5, and n is an integer also ranging from 0 to 5.

Specific examples of the alkyl group, in which at least one carbon atom bonds together with at least three atoms other than hydrogen atoms, are: 2-methylpropyl, t-butyl, 2-methylbutyl, 1,1-dimethylpropyl, 3-methylbutyl, 1,2-dimehtylpropyl, 2-methylpentyl, 1,1-dimethylbutyl, 1-isopropylpropyl, 3-methylpentyl, 1,2-dimethylbutyl, 1-ethyl-1-methylpropyl, 4-methylpentyl, 1,3-dimethylbutyl, 1,1-dimethylpentyl, 1-isopropyl butyl, 1,4-dimethylpentyl, 1-methylpropyl, 1-methyl butyl, 1-methylpentyl, 2-methylhexyl, 1-methyl-4,4-dimethylpentyl, 3,4,4-trimethylpentyl, 3,5,5-trimethyl hexyl, 3-carboxy-1-methylpropyl, 3-carboxybutyl, 3-carboxy-1-methylbutyl, 3-carboxy-1,1-dimethylpropyl, 4-carboxy-3-methylbutyl, 2-carboxy-2-methylpropyl, 3-carboxy-2-methylpropyl, 1-methyl-3-sulfopropyl, 3-sulfobutyl, 3-methyl-4-sulfobutyl, 1-methyl-3-sulfo butyl, 1,1-dimethyl-3-sulfopropyl, 2-methyl-2-sulfopropyl, 2-methyl-3-sulfopropyl, and the like.

Of the alkyl groups generally represented by the formula (III), those in which m is 2 or 3, n is 0 or 1, and A is a sulfo group, are preferred. More preferable are those in which m is 2 and n is 0.

Examples of the organic acid group are: carboxy group, sulfo group, and phospholyl group.

The anion represented as X in the formula (I) is, for example, halogen anion (e.g., $Cl^-$, $Br^-$, or $I^-$), alkylsulfato (e.g., methylsulfato or ethylsulfato), arylsulfonato (e.g., benzenesulfonato, toluenesulfo nato, or 4-chlrobenzenesulfonato, naphthalene-1,5-disulfonato), perchlorato, or alkylcarboxylato (e.g., acetato or propionato). In the formula (I), p takes a value ranging from 0 to 1, which is necessary for balancing electric charges. Its value is 0 in the case where salt is formed within the molecule.

Examples of the 5- or 6-membered heterocyclic ring formed of $Z^1$ and $Z^2$ are as follows:

Thiazole nucleus (e.g., thiazole, 4-methylthiazole, 4-phenylthiazole, 4,5-dimethylthiazole, or 4,5-diphenylthiazole), benzothiazole nucleus (e.g., benzothiazole, 4-chlorobenzothiazole, 5-chlorobenzothiazole, 6-chlorobenzothiazole, 5-nitrobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxy benzothiazole, 6-methoxybenzothiazole, 5-ethoxybenzothiazole, 5-ethoxycarbonylbenzothiazole, 5-carboxy benzothiazole, 5-phenetylbenzothiazole, 5-fluorobenzo thiazole, 5-chloro-6-methylbenzothiazole, 5,6-dimethylbenzothiazole, 5-hydroxy-6-methylbenzothiazole, tetrahydrobenzothiazole, 4-phenylbenzothiazole, 5-styrylbenzothiazole), naphthothiazole nucleus (e.g., naphtho [2,1-d] thiazole, naphtho [1,2-d] thiazole, naphtho [2,3-d] thiazole, 5-methoxynaphtho [1,2-d] thiazole, 7-ethoxynaphtho [2,1-d] thiazole, 8-methoxynaphtho [2,1-d] thiazole, 5-mehoxynaphtho [2,3-d] thiazole), thiazoline nucleus (e.g., thiazoline, 4-methylthiazoline, or 4-nitrothiazoline), oxazolenucleus (e.g., oxazole, 4-methyloxazole, 4-nitroxazole, 5-methyloxazole, 4-phenyloxazole, 4,5-diphenyloxazole, or 4-ethyloxazole), benzoxazole nucleus (e.g., benzoxazole, 5-chlorobenzoxazole, 5-methylbenzoxazole, 5-bromobenzoxazole, 5-fluorobenzoxazole, 5-phenylbenzoxazole, 5-methoxybenz oxazole, 5-nitrobenzoxazole, 5-trifluoromethylbenz oxazole, 5-hydoxybenzoxazole, 5-carboxybenzoxazole, 6-methylbenzoxazole, 6-chlorobenzoxazole, 6-nitrobenz oxazole, 6-methoxybenzoxazole, 6-hydroxybenzoxazole, 5,6-dimethylbenzoxazole, 4,6-dimethylbenzoxazole, or 5-ethoxybenzoxazole), naphthoxazole nucleus (e.g., naphtho [2,1-d] oxazole, naphtho [1,2-d] oxazole, naphtho [2,3-d] oxazole, or 5-nitronaphtho [2,1-d] oxazole), oxazoline nucleus (e.g., 4,4-dimethyloxazoline), selenazole nucleus (e.g., 4-methylselenazole, 4-nitroselenazole, or 4-phenylselenazole), benzoselenazole nucleus (e.g., benzoselenazole, 5-chlorobenzoselenazole, 5-nitrobenzoselenazole, 5-methoxybenzoselenazole, 5-hydroxybenzoselenazole, 6-nitrobenzoselenazole, or 5-chloro-6-nitrobenzoselenazole), napththoselenazole nucleus (e.g., naphtho [2,1-d] selenazole or naphtho [1,2-d] selenazole), tellurazole nucleus (e.g., benzotellurazole, 5-methylbenzotellurazole, 5-methoxybenzotellurazole, or naphtho [1,2-d] tellur azole), 3,3-dialkylindolenine, nucleus (3,3-dimethylindolenine, 3,3-diethylindolenine, 3,3-dimethyl-5-cyanoindolenine, 3,3-dimethyl-6-nitroindolenine, 3,3-dimethyl-5-nitroindolenine, 3,3-dimethyl-5-methoxyindolenine, 3,3,5-trimethylindo lenine, or 3,3-dimethyl-5-chloroindolenine), imidazole nucleus (e.g., 1-alkylimidazole, 1-alkyl-4-phenylimidazole, 1-alkylbenzoimidazole, 1-alkyl-5-chlorobenzo imidazole, 1-alkyl-5,6-dichlorobenzoimidazole, 1-alkyl-5-cyanobenzoimidazle, 1-alkyl-5-cyanobenzoimdazole, 1-alkyl-5-fluorobonzoimdazole, 1-alkyl-5-trifluoromethyl benzoimidazole, 1-alkyl-6-chloro-5-cyanobenzoimidazole, 1-alkyl-6-chloro-5-trifluoromethylbenzoimidazole, 1-alkylnaptho [1,2-d] imidazole, 1-aryl-5,6-dichlorobenzoimidazole, 1-aryl-5-chlorobenzoimdazole, 1-arylimidazole, 1-arylbenzoimidzole, 1-aryl-5-chlorobenzo imidazole, 1-aryl-5,6-dichlorobenzoimidazole, 1-aryl-5-methoxybenzoimidazole, 1-aryl-5-cyanobenzoimidazole, or 1-aryl naphtho [1,2-d] imidazole).

The alkyl group in the 5- or 6-membered heterocyclic ring described above is preferably one having 1 to 8 carbon atoms, such as an unsubstituted alkyl group (e.g., methyl, propyl, isopropyl or a butyl), or a hydroxyalkyl group (e.g., 2-hydroxyethyl or 3-hydroxypropyl). Of these alkyl groups, more preferable are methyl and ethyl. Examples of the aryl group in the heterocyclic ring described above are: phenyl, halogen (e.g., chloro) substituted phenyl, alkyl (e.g., methyl), substituted phenyl, alkoxy (e.g., methoxy) substituted phenyl.

The other examples of the heterocyclic ring are: pyridine nucleus (e.g., 2-pyridine, 5-methyl-2-pyridine, quinoline nucleus (e.g., 2-quino line, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, isoquinoline, 6-nitro-1-isoquinoline, 3,4-dihydro-1-isoquinoline, or 6-nitro-3-isoquinoline), imidazo [4,5-b] quinoxaline nucleus (e.g., 1,3-diethylimidazo [4,5-b] quinoxaline or 6-chloro-1,3-diarylimidazo [4,5-b] quinoxaline), oxadiazole nucleus, thiodiazole nucleus, tetrazole nucleus, and pyrimidine nucleus.

In the formula (I), L1 or L2 is methyne group or substituted methyne group. Examples of the substituted methyne group are methyne groups substituted by a lower alkyl such as methyl or ethyl phenyl, substituted phenyl, methoxy or methoxy. Also in the formula (I), k is 0, 1 or 2.

The following are the examples of the compound represented by the formula (I) and used in the present invention:

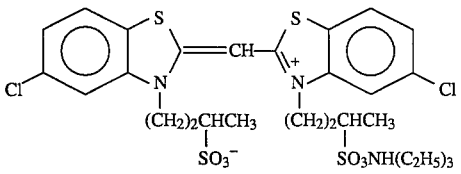

I-1

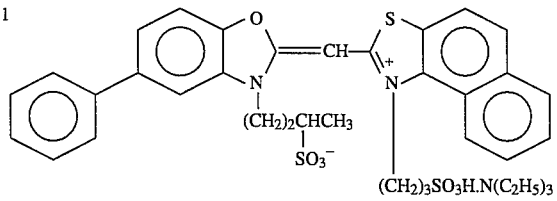

I-2

-continued
I-3
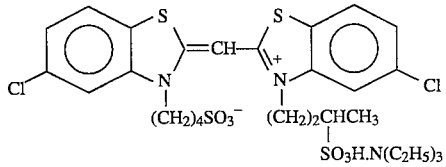
I-4
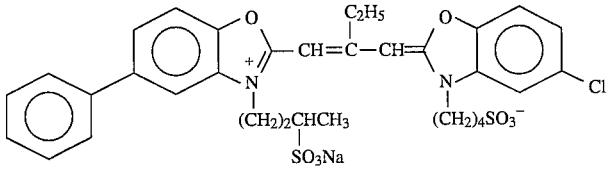
I-5
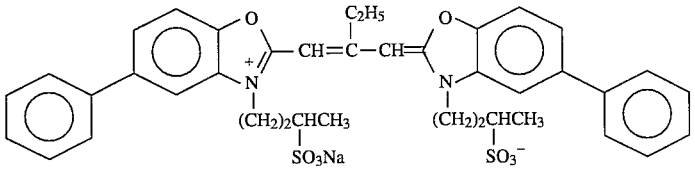
I-6
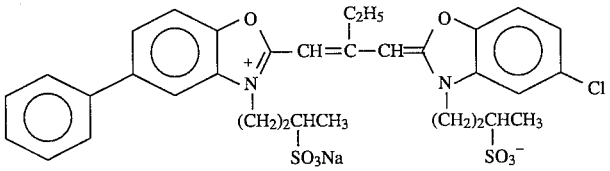
I-7
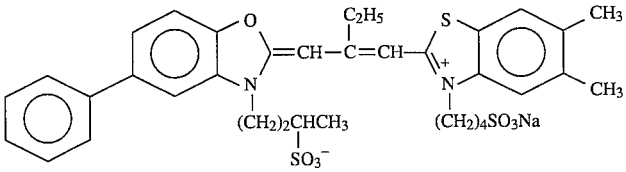
I-8
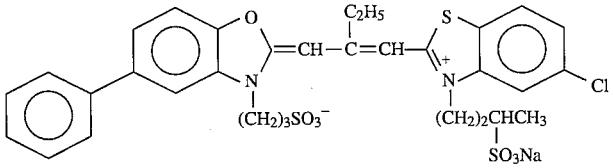
I-9
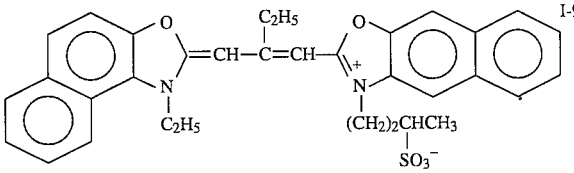
I-10
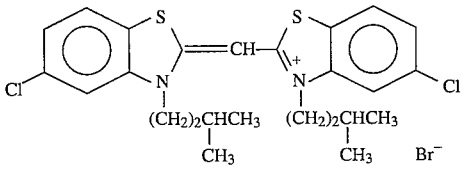
I-11
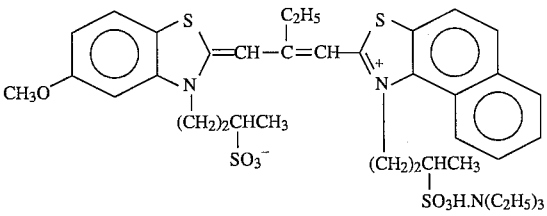
I-12
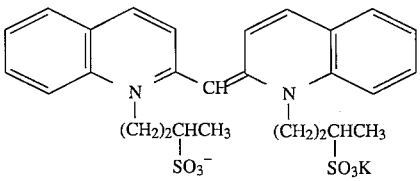
I-13
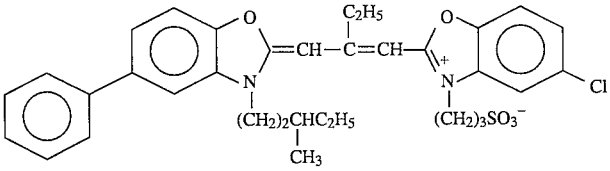

-continued

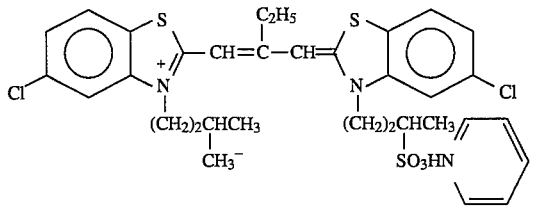

I-14

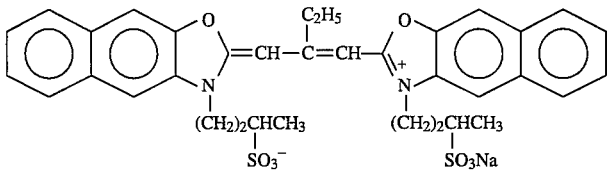

I-15

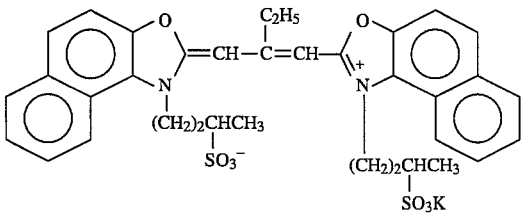

I-16

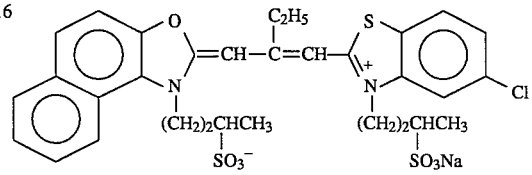

I-17

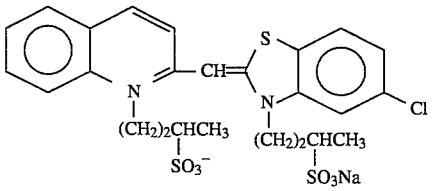

I-18

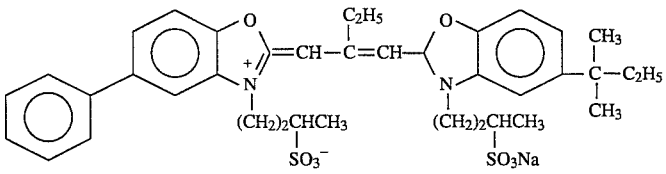

I-19

The saturated adsorption amount of the sensitizing dye (i.e., the spectral sensitizer) represented by the formula (I) can be determined from the adsorption isotherm obtained by separating, by centrifugal method, the dye from the emulsion in which the dye has been adsorbed.

The spectral sensitizer of the formula (I) is used in an amount of 40% or more, preferably 40% to 120%, more preferably 70% to 100%, of its saturated adsorption amount.

The sensitizing dye can be added during the forming of the silver halide grains, during the chemical sensitization, or during the coating of the emulsion.

To add the sensitizing dye during the forming of the silver halide grains, the methods disclosed in U.S. Pat. Nos. 4,225,666, 4,828,972 and JP-A-61-103149 can be employed. To add the dye while desalting the silver halide emulsion, the methods disclosed in European Patent 291, 339-A and JP-A-64-52137 can be used. Further, to add the dye during the chemical sensitization, the method disclosed in JP-A-59-48756 can be employed.

According to the present invention, the emulsion can contain not only the sensitizing dye, but also a dye which has no sensitizing ability or a substance which absorbs virtually no visible light and has supersensitizing ability. For example, the emulsion can contain an aminostyryl compound (e.g., one disclosed in U.S. Pat. Nos. 2,933,390 and 3,635,721), an aromatic organic acid formaldehyde condensate (e.g., one disclosed in U.S. Pat. No. 3,743,510), cadmium salt, and an azinedine compound. Such compounds can be used in various combinations. The combinations disclosed in U.S. Pat. Nos. 3,615,613, 3,615,641, 3,617,295, and 3,635,721 are useful in particular.

JP-A-63-236035 discloses a specific photographic sensitivity of 320 or more, a silver halide color negative photographic material having an silver amount of 3.0 to 8.0 g/m$^2$ and a film thickness of 22 μm or less. This photographic material maintain good graininess, though its film thickness is relatively small due to the short distances among the silver halide grains. The small silver amount of 22 μm or less. This is because the silver content is 8.0 g/cm$^2$ or less. In addition, it has improved sharpness by virtue of its small film thickness. Due to its small film thickness, however, this material is likely to have its photographic properties changed when a pressure is applied to it.

By contrast, the light-sensitive material of the present invention has a high pressure resistance and can, thus, have a small film thickness, owning to the use of the compound represented by the formula (I). It is desirable that the material have a film thickness of 13 to 22 μm, preferably 15 to 21 μm, and more preferably 17 to 20 μm. The term "film thickness" used here means a thickness excluding that of the antihalation layer and that of the interlayer interposed between the antihalation layer and the light-sensitive layer located closer to the support layer than any other light-sensitive layer. Generally, the interlayer has a thickness of 1.5 to 5 μm, preferably 2 to 4 μm.

As is known in the art, the thickness of the protective layer of a color photographic light-sensitive material (i.e., the layer covering the light-sensitive layer located farthest from the support layer) greatly influences the sharpness of the color photographic light-sensitive material. Usually, the protective layer is 2 to 3 μm thick. If is thinner, it will have its sharpness increased, but it will more likely have friction fog. In particular, the blue-sensitive layer, one of the upper layers, is likely to have friction fog when its surface is scratched. Any blue-sensitive emulsion of the material according to the present invention contains the compound of the formula (I), and hardly have friction fog. Hence, the color photographic light-sensitive material of the invention has improved sharpness. The protective layer of the material according to the present invention is preferably 0.5 to 3 μm, more preferably 1 to 2.5 μm.

The film thickness of the light-sensitive material is determined by the following method. First, the thickness of the entire material is measured with a commercially available contact-type thickness measuring meter (K-402 BSTAND manufactured by Anritsu Electric Co., Ltd.), after the material has been left to stand for 2 days at 25° C. and relative humidity of 55% or less. Then, all coated layers were removed from the support layer, and the thickness of the support layer is measured with the contact-type meter. The thickness of the support layer is subtracted from the thickness of the whole material, thereby finding the thickness of the hydrophilic colloidal layer including the emulsion layers. The thicknesses of the individual layers of the material are determined from the thickness of the colloidal layer and also from the the thicknesses of the layers measured by means of a scanning electron microscope. The microscope-measuring may not provide an accurate thickness of each layer since the sample must be placed in vacuum, allowing water and any substance having a low boiling point to evaporate, making the layer slightly thinner. Even if the sample is freeze-dried to enhance the measuring accuracy, the thickness of the layer can hardly be measured with high precision. The scanning electron microscope is used in order to determine the thickness of the individual layer of the dry sample based on the total thickness measured by the contact-type thickness measuring meter.

According to the invention, the specific sensitivity of the color photographic light-sensitive material is determined by the method which is disclosed in JP-A-63-236035. This method is identical to the method of JIS K 7614-1981, except for two respects only. First, development is finished between 30 minutes to 6 hours after it has been subjected to exposure for sensitometry. Second, the sample was developed in the Fuji Film standard process CN-16.

The present inventors have found that a red-sensitive emulsion layer can have an increased sharpness if it contains less organic solvent having a high boiling point. They also have learned that the friction fog on the red-sensitive emulsion layer will become prominent if the content of the organic solvent is decreased. Nonetheless, the compound of the formula (I) suppresses the friction fog on the red-sensitive emulsion layer.

The organic solvent having a high boiling point, which is used in the invention, along with the compound of the formula (I), will be described in detail.

The organic solvent for use in the invention is one having a boiling point of 175° C. at normal pressure (i.e., 760 mmHg). Examples of this solvent are: ester phosphates (e.g., triphenyl phosphate, tricresyl phosphate, octyldiphenyl phosphate, tri-2-ethylhexyl phosphate, tri-n-hexyl phosphate, tri-iso-nonyl phosphate, tricycloethyl phosphate, tributoxyethyl phosphate, and tri-2-chloroethyl phosphate), benzoates (e.g., 2-ethylhexyl benzoate and 2,4-dichloro-2-ethylhexyl benzoate), fatty esters (e.g., di-2-ethylhexyl succinate, 2-hexyldecyl tetradecanate and tributyl citrate), amides (e.g., N,N-diethyldodecane amide and N-tetradecyl pyrrolidone), dialkyl anilines (e.g., 2-butoxy-5-tert-octyl-N, N-dibutyl aniline), chloridized paraffins (e.g., paraffins containing 10 to 80% of chlorine), phenols (e.g., 2,5-di-tert-amyl phenol, 2,5-di-tert-hexyl-4-methoxy phenol, and p-hydroxy 2-ethylhexyl benzoate), ester phthalates (e.g., dibutyl phthalate, dicyclohexyl phthalate, diheptyl phthalate, di-2-ethylhexyl phthalate, and didocecyl phthalate), and the like. Of these examples, esters phosphates and ester phthalates are preferable in particular.

The amount in which to add the high-boiling organic solvent to each layer is determined by the total amount of the couplers used in the layer. According to the invention, the solvent is used in an amount of 0.3 g or less per gram of the couplers. If the solvent is used in a greater amount, it will degrade the sharpness. The amount is preferably 0.15 g or less, more preferably 0.05 g or less, still more preferably 0.01 g or less, per gram of the couplers contained in the layer.

The term "total amount of the couplers" means the sum of the amounts of the cyan couplers contained in any silver halide emulsion layer of the light-sensitive material containing at least one of the cyan couplers represented by the formula (II).

It is desirable that each silver halide emulsion layer containing cyan couplers be red-sensitive and comprise at least two sub-layers having different sensitivities, each containing at least one cyan coupler of the formula (II).

It is also desirable that at least one of the sub-layers forming the red-sensitive layer contain two or more cyan couplers generally represented by the formula (II). Preferably, such a sub-layer contains no high-boiling organic solvents. According to the present invention, the amount of the cyan coupler of the formula (II) falling inside the range of the present invention (amount ratio of high boiling point organic solvent to coupler: 0.3 or less) is usually $1.0\times10^{-5}$ to $3.0\times10^{-3}$ mol/m$^2$, preferably $5.0\times10^{-5}$ to $1.5\times10^{-3}$ mol/m$^2$.

Specific examples of the cyan couplers generally identified by the formula (II) are those, each being a combination of the various groups, as disclosed in JP-A-1-131558.

In any coupler of the formula (II), dimers or polymers can be formed which are attached to one another through bivalent or polyvalent groups, at the substituent group $R_{11}$, $R_{12}$, $R_{13}$, or T. In this case, each substituent group can have carbon atoms the number of which falls outside the range specified in JP-A-131558.

Specific examples of the coupler used in the present invention and represented by the formula (II) are couplers A-1 to A-75 which are represented by the following formulas. Nonetheless, the coupler is not limited to these examples.

(A-1)
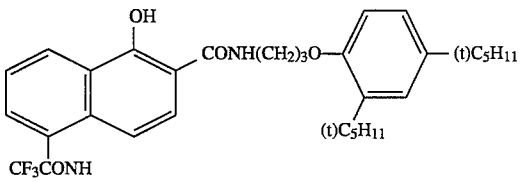
(A-2)
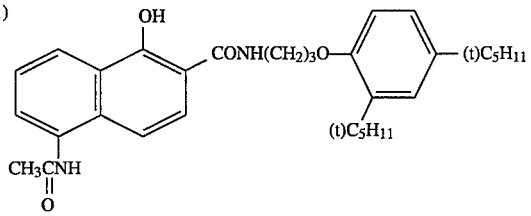
(A-3)
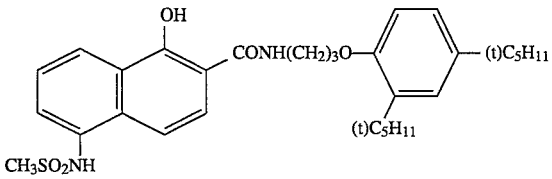
(A-4)
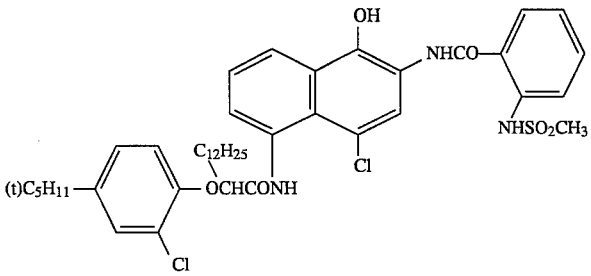
(A-5)
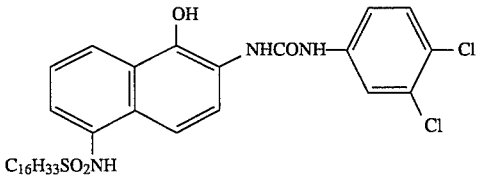
(A-6)
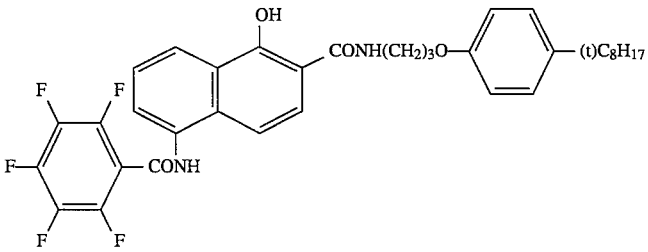
(A-7)
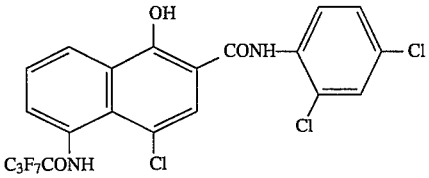
(A-8)
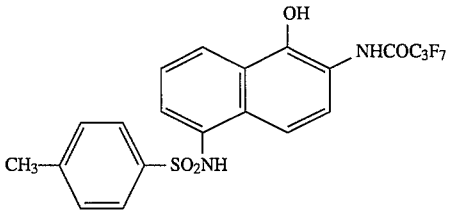
(A-9)
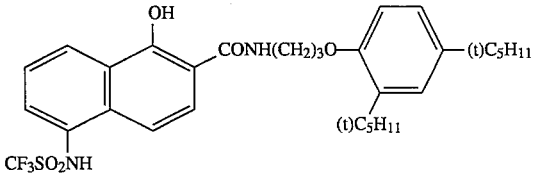
(A-10)
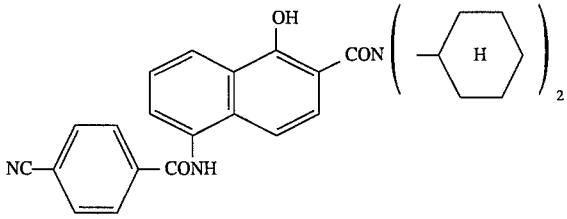

-continued
(A-11)
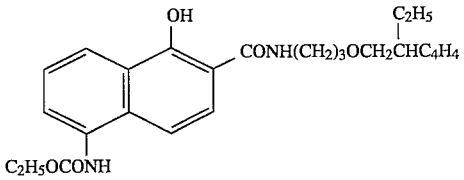
(A-12)
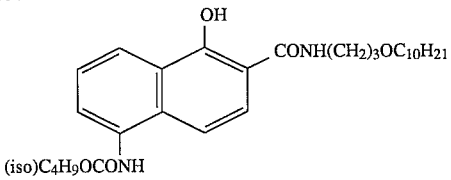
(A-13)
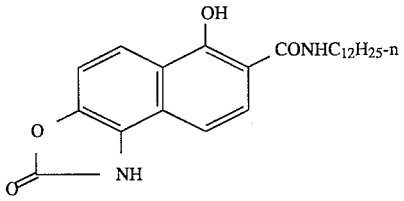
(A-14)
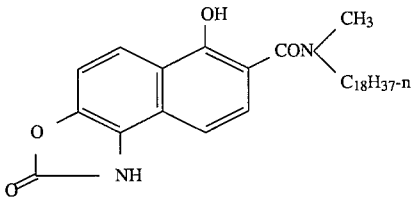
(A-15)
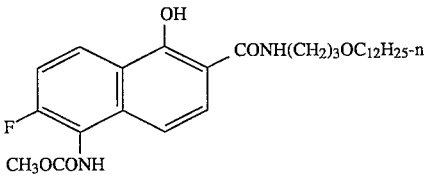
(A-16)
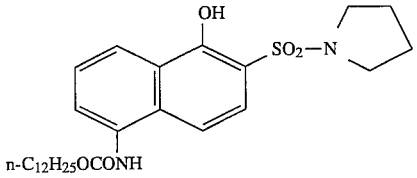
(A-17)
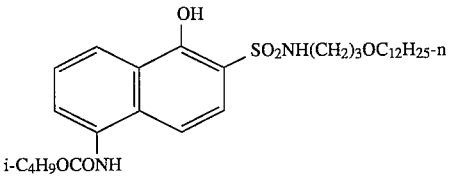
(A-18)
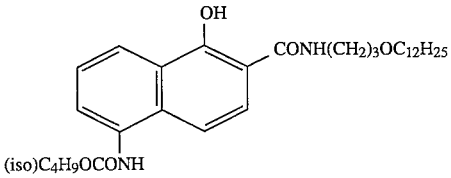
(A-19)
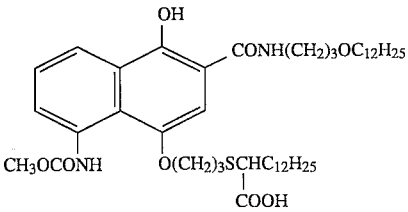
(A-20)
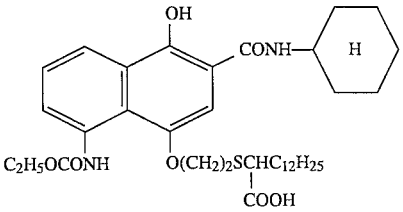
(A-21)
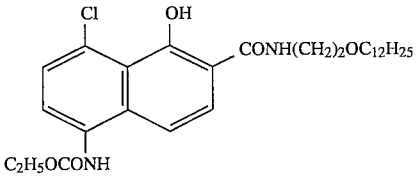
(A-22)
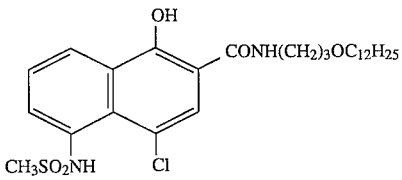
(A-23)
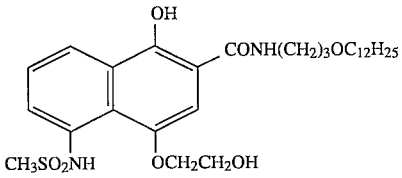
(A-24)
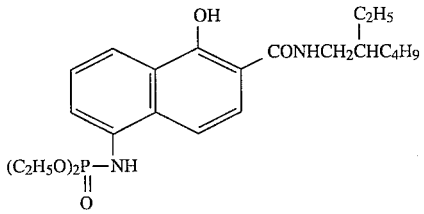
(A-25)
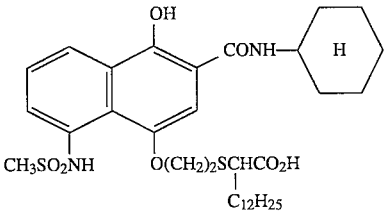
(A-26)
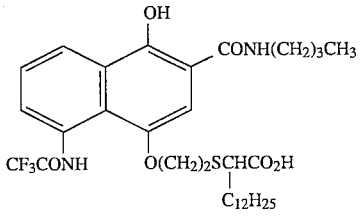

-continued
(A-27)
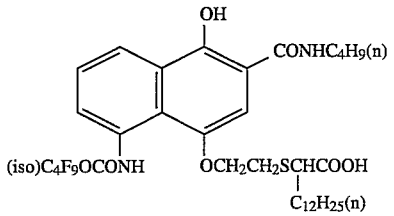
(A-28)
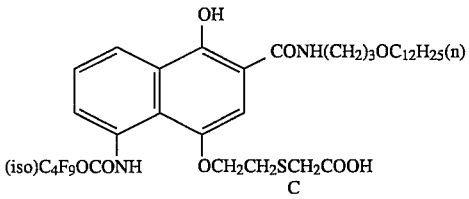
(A-29)
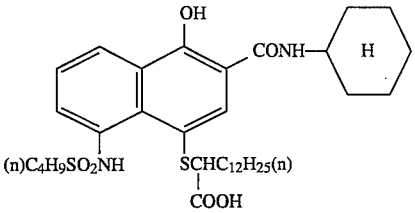
(A-30)
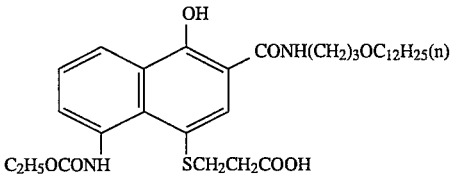
(A-31)
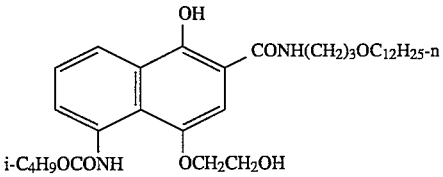
(A-32)
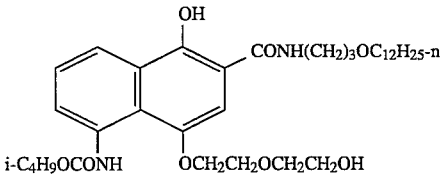
(A-33)
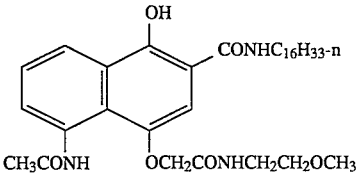
(A-34)
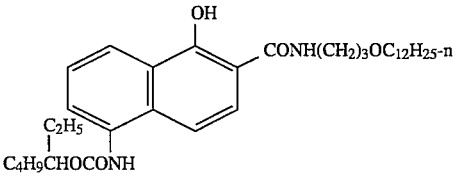
(A-35)
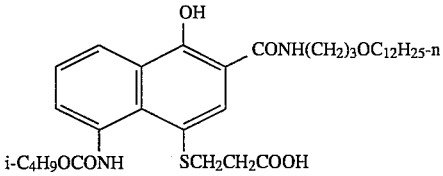
(A-36)
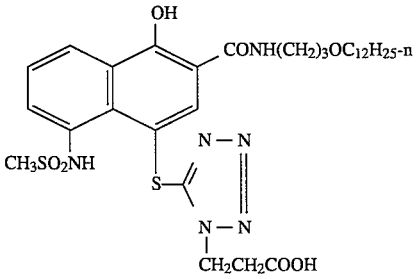
(A-37)
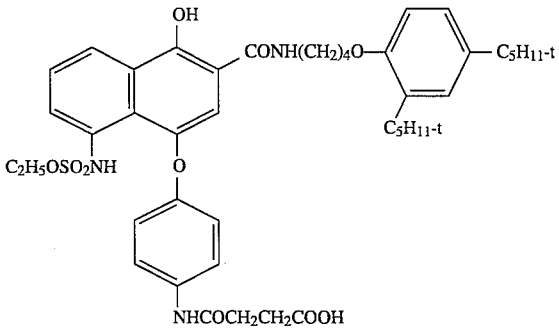

-continued
(A-38)
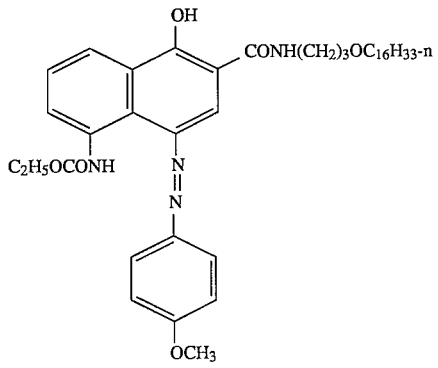
(A-39)
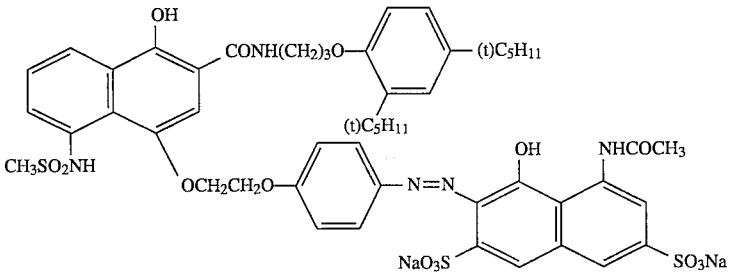
(A-40)
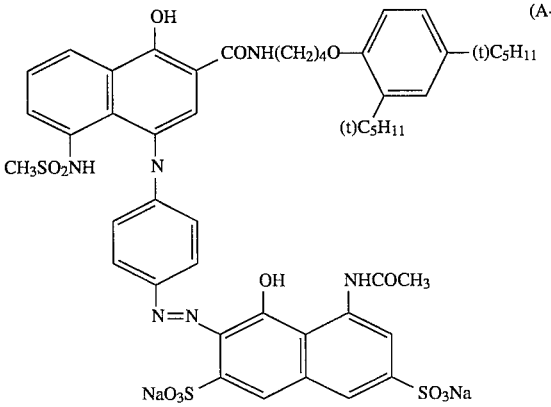
(A-41)
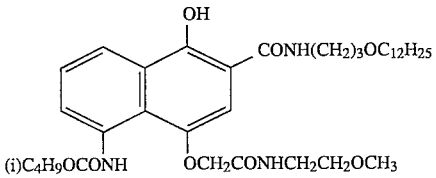
(A-42)
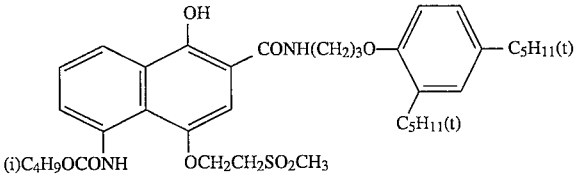
(A-43)
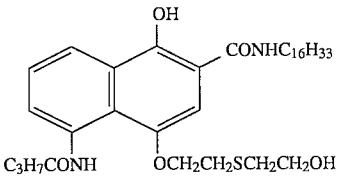

-continued
(A-44)
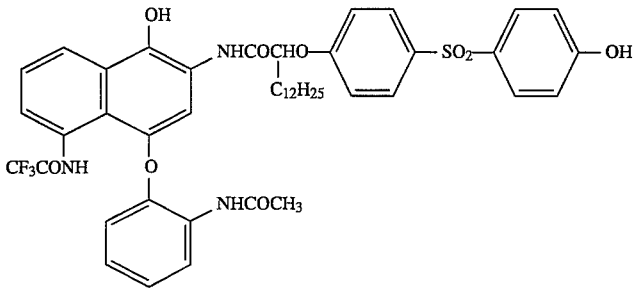
(A-45)
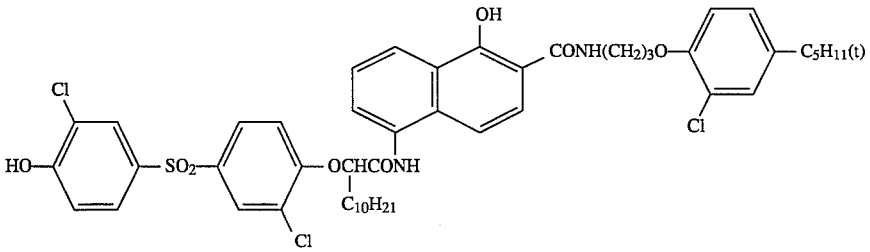
(A-46)
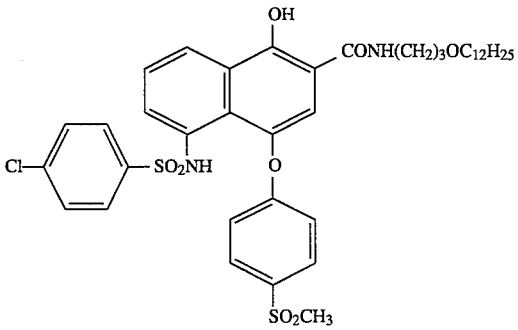
(A-47)
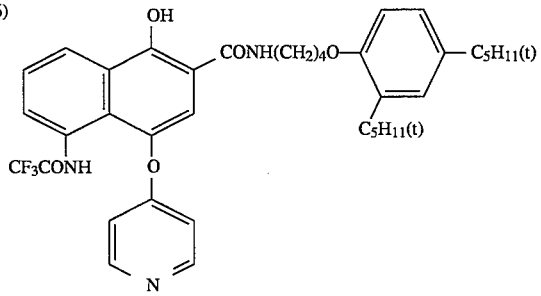
(A-48)
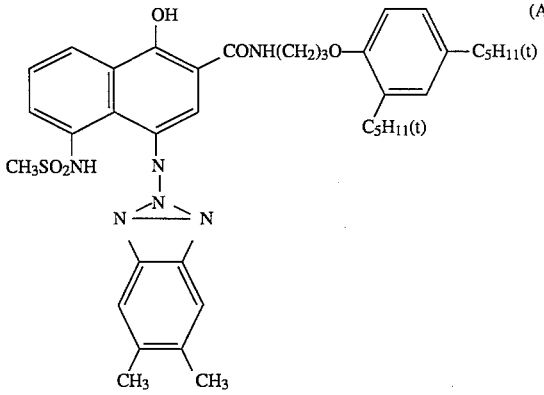
(A-49)
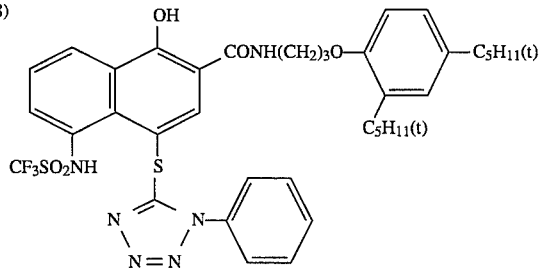
(A-50)
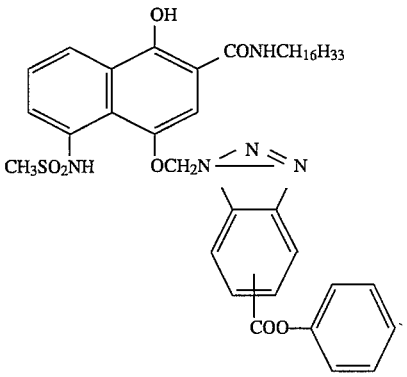
(A-51)
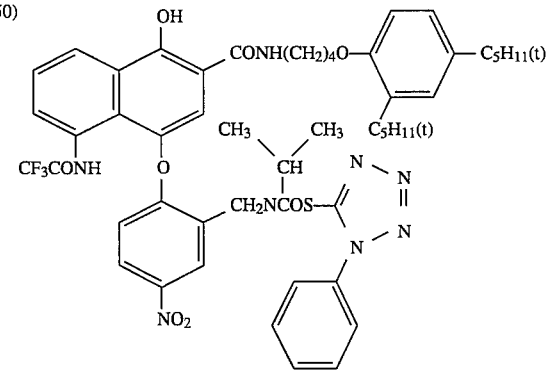

-continued
(A-52)
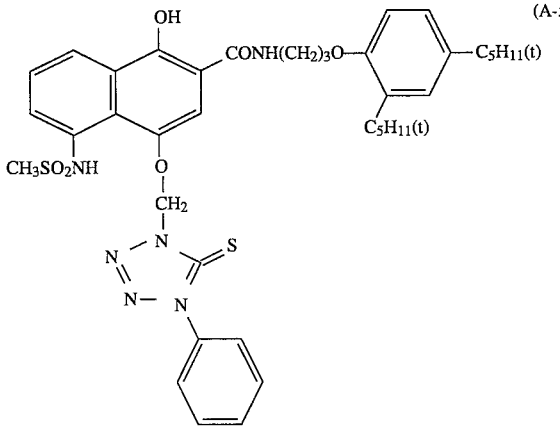
(A-53)
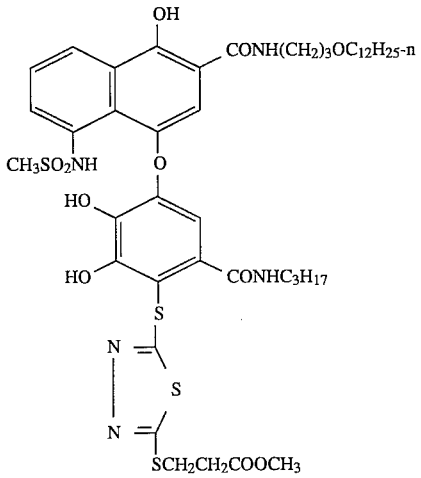
(A-54)
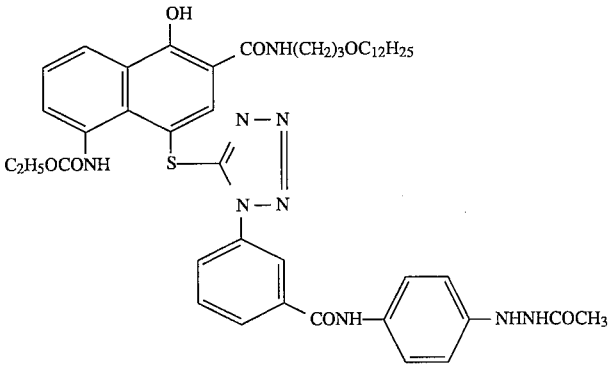
(A-55)
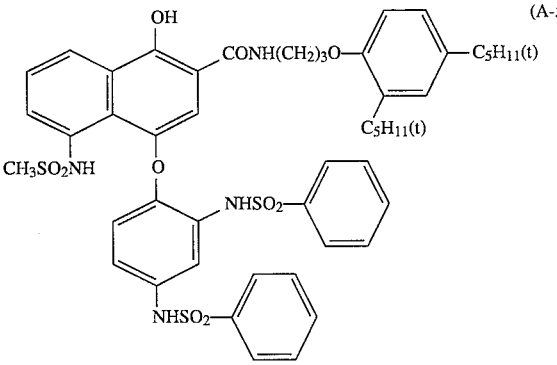
(A-56)
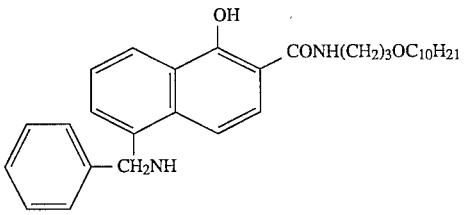
(A-57)
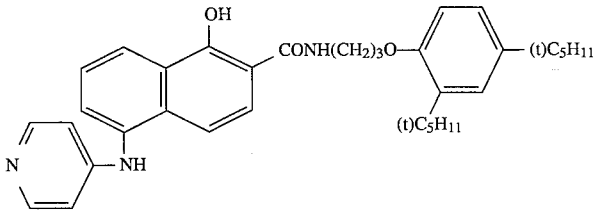
(A-58)
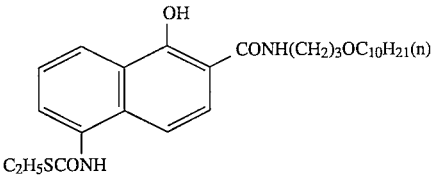

-continued
(A-59)
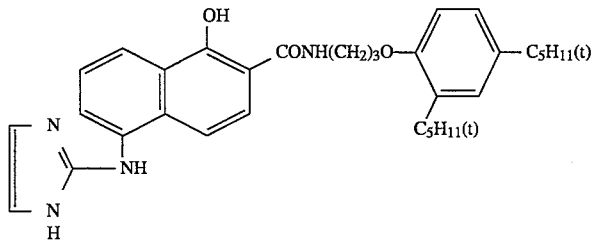
(A-60)
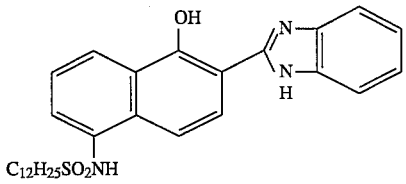
(A-61)
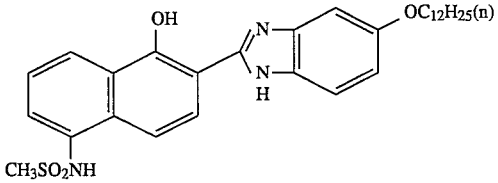
(A-62)
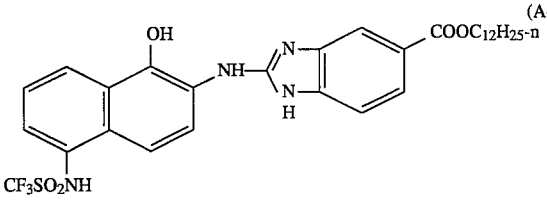
(A-63)
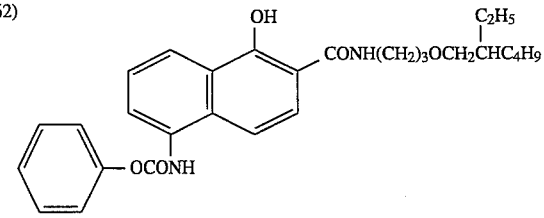
(A-64)
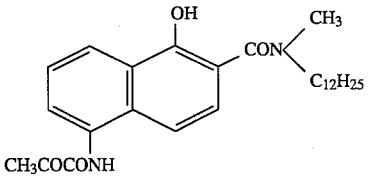
(A-65)
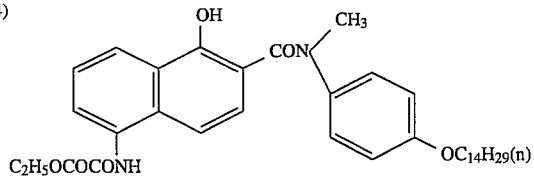
(A-66)
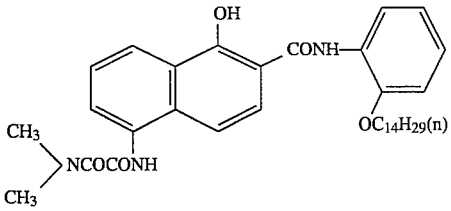
(A-67)
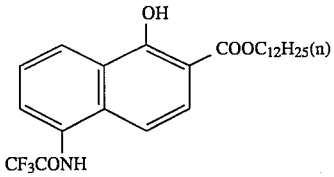
(A-68)
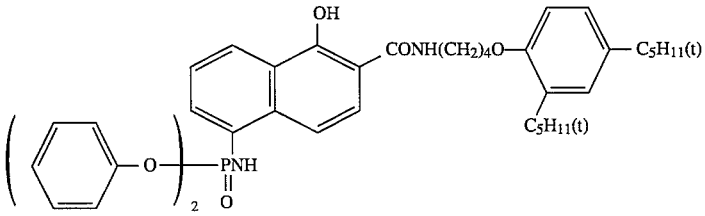
(A-69)
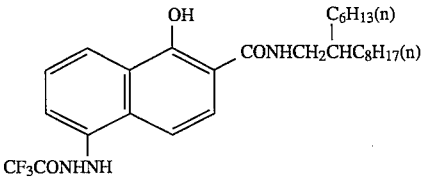
(A-70)
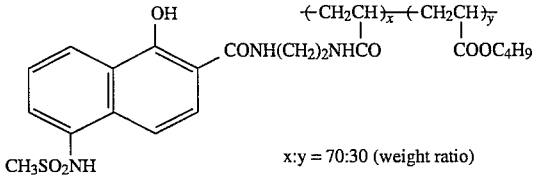
x:y = 70:30 (weight ratio)

-continued (A-71)

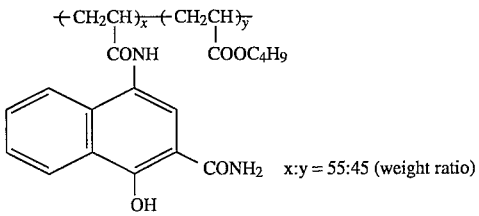

x:y = 55:45 (weight ratio)

(A-72)

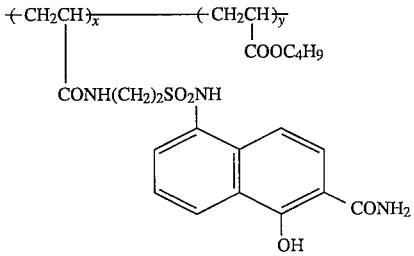

x:y = 80:20 (weight ratio)

(A-73)

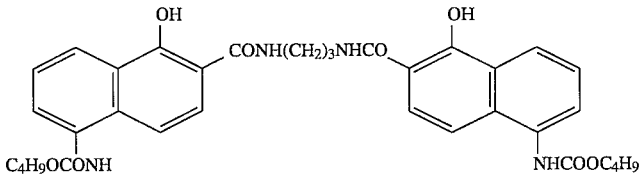

(A-74)

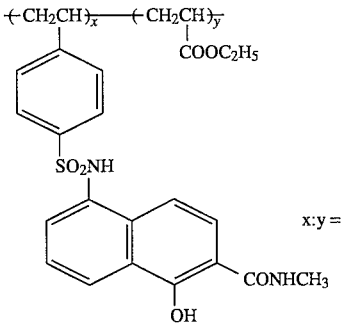

x:y = 60:40 (weight ratio)

(A-75)

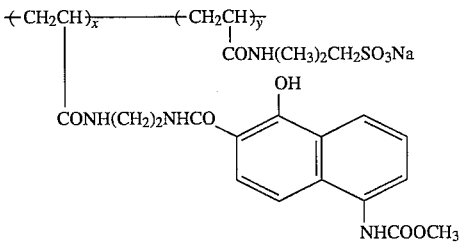

x:y = 50:50 (weight ratio)

Specific examples of the coupler used in the invention and represented by the formula (II), other than those mentioned above, and the methods of synthesizing these couplers are disclosed in JP-A-60-237448, JP-A-61-153640, JP-A-61-145557, JP-A-63-208042. These couplers can also be synthesized by the methods disclosed in JP-A-62-123157, JP-A-62-123158, and JP-A-63-258446.

The compound of the formula (I) is preferably used, in any layer which contains the cyan coupler represented by the general formula (II) and in which an amount of the high-boiling organic solvent is limited.

The compound of the formula (I) can achieve desired effects even if used in layers which contains cyan couplers other than those of the formula (II). It can also achieve desired effects if used in an emulsion layer which contains a high-boiling organic solvent which functions as a dispersant and used in an amount of 0.1 to 0.3 times the amount of the magenta or yellow coupler contained in the emulsion layer.

The light-sensitive material of the present invention need only have at least one of silver halide emulsion layers, i.e., a blue-sensitive layer, a green-sensitive layer, and a red-sensitive layer, formed on a support. The number or order of the silver halide emulsion layers and the non-light-sensitive layers are particularly not limited. A typical example is a silver halide photographic light-sensitive material having, on a support, at least one light-sensitive layers constituted by a plurality of silver halide emulsion layers which are sensitive to essentially the same color sensitivity but has different sensitivity. In a multilayered silver halide color photographic light-sensitive material, the light-sensitive layers are unit light-sensitive layer sensitive to blue, green or red. The unit light-sensitive layers are generally arranged such that red-, green-, and blue-sensitive layers are formed from a support side in the order named. However, this order may be reversed or a layer sensitive to one color may be sandwiched between layers sensitive to another color in accordance with the application.

Non-light-sensitive layers such as various types of interlayers may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038, and may further contain a color mixing inhibitor which is normally used.

As a plurality of silver halide emulsion layers constituting each unit light-sensitive layer, a two-layered structure of high- and low-sensitivity emulsion layers can be preferably used as described in West German Patent 1,121,470 or British Patent 923,045. In this case, layers are preferably arranged such that the sensitivity is sequentially decreased toward a support, and a non-light-sensitive layer may be formed between the silver halide emulsion layers. In addition, as described in JP-A-57-112751, JP-A-62-200350, JP-A-62-206541, and JP-A-62-206543, layers may be arranged such that a low-sensitivity emulsion layer is formed remotely from a support and a high-sensitivity layer is formed close to the support.

More specifically, layers may be arranged from the farthest side from a support in an order of low-sensitivity blue-sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL), an order of BH/BL/GL/GH/ RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-B-56-25738 and JP-B-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities may be arranged such that the sensitivity is sequentially decreased toward the support. When a layer structure is constituted by three layers having different sensitivities, these layers may be arranged in an order of medium-sensitivity emulsion layer/high-sensitivity emulsion layer/low-sensitivity emulsion layer from the farthest side from a support in a layer sensitive to one color as described in JP-A-59-202464.

In addition, an order of high-sensitivity emulsion layer/low-sensitivity emulsion layer/medium-sensitivity emulsion layer or low-sensitivity emulsion layer/medium-sensitivity emulsion layer/high-sensitivity emulsion layer may be adopted.

Furthermore, the arrangement can be changed as described above even when four or more layers are formed.

As described above, various layer types and arrangements can be selected in accordance with the application of the light-sensitive material.

A preferable silver halide contained in photographic emulsion layers of the photographic light-sensitive material of the present invention is silver iodobromide, silver iodochloride, or silver iodochloro bromide containing about 30 mol % or less of silver iodide. The most preferable silver halide is silver iodobromide or silver iodochlorobromide containing about 2 mol % to about 10 mol % of silver iodide.

Silver halide grains contained in the photographic emulsion may have regular crystals such as cubic, octahedral, or tetradecahedral crystals, irregular crystals such as spherical or tabular crystals, crystals having crystal defects such as twinned crystal faces, or composite shapes thereof.

The above emulsion may be of any of a surface latent image type in which a latent image is mainly formed on the surface of each grain, an internal latent image type in which a latent image is formed in the interior of each grain, and a type in which a latent image is formed on the surface and in the interior of each grain. However, the emulsion must be of a negative type. When the emulsion is of an internal latent image type, it may be a core/shell internal latent image type emulsion described in JP-A-63-264740. A method of preparing this core/shell internal latent image type emulsion is described in JP-A-59-133542. Although the thickness of a shell of this emulsion changes in accordance with development or the like, it is preferably 3 to 40 nm, and most preferably, 5 to 20 nm.

A silver halide emulsion layer is normally subjected to physical ripening, chemical ripening, and spectral sensitization steps before it is used. Additives for use in these steps are described in Research Disclosure Nos. 17,643, 18,716, and 307,105 and they are summarized in the following table.

In the light-sensitive material of the present invention, two or more types of emulsions different in at least one characteristic of a grain size, a grain size distribution, a halogen composition, a grain shape, and sensitivity can be mixed in one layer.

A surface-fogged silver halide grain described in U.S. Pat. No. 4,082,553, an internally fogged silver halide grain described in U.S. Pat. No. 4,626,498 or JP-A-59-214852, and colloidal silver can be preferably used in a light-sensitive silver halide emulsion layer and/or a substantially non-light-sensitive hydrophilic colloid layer. The internally fogged or surface-fogged silver halide grains are silver halide grains which can be uniformly (non-imagewise) developed in either a non-exposed portion or an exposed portion of the light-sensitive material. A method of preparing the internally fogged or surface-fogged silver halide grain is described in U.S. Pat. No. 4,626,498 or JP-A-59-214852.

A silver halide which forms the core of an internally fogged core/shell type silver halide grain may have the same halogen composition as or a different halogen composition from that of the other portion. Examples of the internally fogged or surface-fogged silver halide are silver chloride, silver chlorobromide, silver iodobromide, and silver chloroiodobromide. Although the grain size of these fogged silver halide grains is not particularly limited, an average grain size is preferably 0.01 to 0.75 μm, and most preferably, 0.05 to 0.6 μm.

Available as other preferred silver halide grains to be used in any photographic emulsion layer of the light-sensitive material according to the the present invention are monodisperse ones. Grains are regarded as "monodisperse" if they have a variation coefficient of 20% or less, satisfying the following relation:

$$(S/r)\times 100 \leqq 20\%$$

where S is the standard deviation S of the grains, r is the average size of the grains.

The term "standard deviation" used here is of the statistical meaning. The term "size" is the diameter of a grain if the grain is spherical, or the diameter of a circle having the same area as the projected image of a grain if the grain is not spherical. Hereinafter, the diameter of the latter definition will be called "equivalent-sphere diameter." The term "average size r" is defined as:

$$r=(\Sigma n_i r_i)\Sigma n_i$$

where $r_i$ is the diameters of $n_i$ grains existing in a system.

The monodisperse silver halide grains can comprise either one core and one shell or one core and two or more shells, as has been described.

Monodisperse silver halide grains serve not only to improve the graininess of light-sensitive material, but also to enhance the sharpness thereof, particularly if they are of such a size as to scatter light little various types of monodisperse silver halide grains are known, as is disclosed in JP-A-54-48521, JP-A-54-99419, JP-A-56-16124, JP-A-56-78831, U.S. Pat. No. 4,444,877, JP-A-57-182730, JP-A-58-49938, JP-A-58-37635, U.S. Pat. No. 4,446,228, JP-A-58-106532, JP-A-58-107530, JP-A-58-126531, JP-A-58-149037, JP-A-59-10947, JP-A-59-29243, JP-A-59-72440, JP-A-59-140443, JP-A-59-148049, JP-A-59-177535, and JP-A-59-152438.

Silver halide grains of another type, which can be used in the light-sensitive material of this invention are tabular grains. These do not scatter light much, thus serving to improve image sharpness, and are therefore desirable. Tabular silver halide grains are described in detail in U.S. Pat. No. 4,434,226, 4,414,310, 4,433,048, and 4,439,520, and also in British Patent 2,112,157.

The ratio of the thickness of a tabular grain to the equivalent-sphere diameter of the grain is known as "aspect ratio" in the art. Tabular grains having an aspect ratio of 1 or more can be used in the present invention. The use of tabular grains in an emulsion is advantageous in two respects, as is described in U.S. Pat. No. 4,434,226. First, the emulsion can be coated on another layer more readily than if it contains no tabular grains. Second, the grains help to increase the sensitizing ability of any sensitizing dye contained in the emulsion. It is desirable that tabular grains having aspect ratios of 3 or more but less than 100, preferably 3 or more but less than 20, more preferably 3 or more but less than 10, occupy 50% or more of the total projected area of all silver halide grains contained in each emulsion. The tabular grains can be of various shapes, such as triangular, hexagonal, and circular. Preferable are hexagonal tabular grains, each having the six sides of substantially the same length, which are disclosed in U.S. Pat. No. 4,797,354.

In most cases, the size of tabular grains is specified in terms of their equivalent-sphere diameter. Tabular grains having an average size of 0.6 microns or less, such as the grains disclosed in U.S. Pat. No. 4,748,106, are preferred since they serve to improve image quality. Emulsions containing grains whose size-distribution range is narrow are also preferred. Tabular grains having thicknesses of 0.5 microns or less, preferably 0.3 microns or less, are desirable since they serve to increase the sharpness of the light-sensitive material. Further, grains having variation coefficient of 30% or less, thus being relatively uniform in thickness, are also preferred. The grains disclosed in JP-A-63-163451, which are identified by their thicknesses and the distance between their twined crystal planes, can be preferably used, too, in the present invention. The dislocation lines of a tabular grain can be observed by means of a transmission electron microscope. Tabular grains having no dislocation lines, tabular grains each having a few dislocation lines, or tabular grains each having many dislocation lines can be desirably used, in accordance with the purpose of using the grains. Of tabular grains having dislocation lines, some have dislocation lines straightly introduced along a specific crystal axis of the grain, some others have curving dislocation lines, some other still have dislocation lines introduced into the grains entirely, and other grains have dislocation lines introduced into only a specific part, e.g., fringe portions of the grains. Introduction of the dislocation lines is preferred to not only tabular grains, but also to regular crystal grains and potato-shaped grains. Of these regular crystal grains and potato-shaped grains, those having dislocation lines introduced into a limited portion are more preferred.

To enhance the image sharpness effectively, it is desirable to use tabular grains in blue-sensitive layers and monodisperse grains in green- and red-sensitive layers, as is detailed in JP-A-63-89839.

In order to prevent metal impurities from accidentally mixing into silver halide grains, various measures are taken in the present invention. Not only are metal impurities removed from the essential raw materials for preparing the silver halide emulsion, such as wafer, hydrophilic colloid, soluble silver salt (e.g., silver nitrate), soluble halogenated alkali (e.g., KBr, KCl, KI, NaBr or NaCl). But also are they prevented from being released from the reaction vessel in which the emulsion is prepared. Further, the reaction conditions (e.g., temperature) are adjusted, thereby to prevent metal impurities from mixing into the emulsion being prepared.

The photographic emulsion for use in the present invention can be prepared by methods described in, for example, P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964. In other words, the emulsion can be prepared by acidification, neutralization, or ammonification. To react a soluble silver salt with soluble halogen salt, one-side mixing or simultaneous mixing, or the combination thereof can be employed. Silver halide grains can be formed by means of so-called "reverse mixing," in which the grains are formed in the presence of an excessive amount of silver ions.

One of the simultaneous mixing methods is so-called "controlled double-jet method." In this method, pAg in the liquid in which to form silver halide grains is maintained at a prescribed value. This method can be used in this invention, thereby to obtain silver halide grains which have a regular crystal shape and a virtually uniform size.

Two or more types of silver halide emulsions, prepared separately, can be mixed and used in the present invention.

According to the invention, it is recommended to use the silver halide grains disclosed in Kokai Giho 86-9598, which have a crystal plane defined by Miller indices (nn1), where n is a natural number and equal to or greater than 2.

Silver halide emulsions of the type disclosed in JP-A-2-135439 and JP-A-2-168247, which have been reduction-sensitized, are highly sensitive to light and are therefore useful in the present invention.

Silver halide emulsions of the type disclosed in JP-A-61-14630 and JP-A-60-122935, which contain silver halide grains which have been grown in the presence of tetrazinedine, have a high content of silver iodide and greatly monodispersive. Hence, these emulsions are very sensitive to light and have excellent graininess, and can therefore be preferably used in the present invention.

Further, silver halide emulsions of the type described in JP-A-58-126526, which have been gold-sulfur sensitized or gold-selenium sensitized in the presence of a nitrogen-containing heterocyclic compound, are low-fog ones and have a high light-sensitivity. These can, therefore, be preferably used in the present invention.

The silver halide emulsions disclosed in JP-A-59-14945 and JP-A-59-149344, which contain slightly rounded cubic or tetradecahedral crystals, are highly sensitive to light. Hence, they are preferable for use in the present invention.

Silver halide grains can be formed or physically ripened, in the presence of cadmium salt, zinc salt, lead salt, thallium salt, iridium salt, complex salt of iridiuim, rhodium salt, complex salt of rhodium, iron salt, or complex salt of iron. Emulsions containing silver halide grains formed in the presence of indium exhibit a high sensitivity, as is disclosed in JP-B43-4935 and JP-B-45-32738. Thus, these emulsions are particularly preferred in the present invention.

The soluble salts are removed from the emulsion after precipitates have been formed or after the emulsion has been physically ripened. These salts can be removed by the well-known Nudel washing, in which gelatin is gelled and used. Alternatively, the salts can be removed by means of flocculation, in which use is made of inorganic salts made of polyanions, such as sodium sulfate, an anionic surfactant, an anionic polymer (e.g., polystyrene sulfonic acid), or a gelating derivative (e.g., aliphatic acyl gelatin, aromatic acyl gelatin, aromatic carbamoyl gelatin.

In most cases, silver halide emulsions are chemically sensitized. The emulsions can be chemically sensitized by, for example, the method disclosed in H. Frieser, ed., "Die Grundlagen der Photographischen Prozesse mit Silber-halogeniden," Akademishe Verlagsgesellschaft, 1968, pp. 675–734.

More specifically, sulfur sensitization, reduction sensitization, nobel metal sensitization, and selenium sensitization can be employed, either singly or in combination. In the sulfur sensitization, use is made of a sulfur-containing compound that can react with silver or activated gelatin, such as thiosulfate, thiourea, mercapto compound, or rhodanine. In the reduction sensitization, use is made of a reducing substance such as stannous salt, amine, hydrazine derivative, formamidine sulfinic acid, or silane compound. In the nobel metal sensitization, use is made of gold complex salt or complex salt of a metal of Group VIII (e.g., Pt, It, or Pd). In the selenium sensitization, use is made of a selenium compound such as selenourea, selenoketone, or selenide.

The photographic emulsion used in the invention can contain various compounds to prevent fogging from occurring during the manufacture, storage or processing of the light-sensitive material, or to stabilize photographic performance. Examples of these compounds are azoles such as benzothiazolium salt, nitroinda zole, triazole, benzotriazole, and benzimidazole (particularly, nitro- or halogen-substituted one); heterocyclic mercapto compounds such as mercaptothiazole, mercaptobenzothiazole, mercaptobenzimidazole, mercaptothiadiazole, mercaptotetrazole (particularly, 1-phenyl-5-mercaptotetrazole), and mercaptopyridine; heterocyclic mercapto compound having water-soluble group such as carboxyl group or sulfo group; thioketo compounds such as oxazolinethion; azinedines such as tetrazine dine (particularly, 4-hydroxy-substituted (1, 3, 3a, 7) tetrazinedines); benzenethiosulfonic acids; and benzensulfinic acids.

These antifoggants and stabilizing agents are usually added after the chemical sensitization. Preferably, they can be added before or during the chemical ripening of the silver halide grains. To be more precise, they can be added at any time during the forming of the silver halide grains, while the silver salt solution is being added, before the chemical ripening is started, or while the grains are being chemically ripened (preferably, within the first half of the chemical ripening period, more preferably within the first one-fifth thereof).

The amount in which to use the above-mentioned compounds are added cannot be determined by the method of adding them or the amount of silver halide used. Nonetheless, they should be used in an amount of $10^{-7}$ to $10^{-2}$ mol, preferably $10^{-5}$ to $10^{-2}$ mol, per mol of silver halide used.

As has been described, the silver halide emulsion is subjected to spectral sensitization so that it may be used in a color negative photographic material having a specific photographic sensitivity of 320 or more. Thus, the emulsion is rendered more sensitive to visible light rays having wavelengths falling within a desired range. It is necessary to minimize the ability degradation of the material, which results from natural radiation. In view of this, the emulsion should better have as low a sensitivity to natural radiation as possible. According to the studies of the present inventors, the radiation sensitivity of any silver halide emulsions is closely related with the specific sensitivity of the light-sensitive material, not necessarily with the so-called "color-sensitized sensitivity" thereof. Hence it is desirable to use a silver halide emulsion which a high color-sensitized sensitivity and a low specific sensitivity, so that the light-sensitive material may not have its ability degraded, while remaining sufficiently sensitive to light. Therefore, a supersensitizing dye of the type described above should better be used, thereby to increase the color-sensitized sensitivity, without changing the specific sensitivity of the material. Also is it desirable to add the dye so much as to decrease the specific sensitivity of the material, but not so much as to reduce the color-sensitized sensitivity considerably. Further, it is proposed that tabular grains which have an aspect ratio of 5 or more and which are color-sensitized effectively with a sensitizing dye.

Tabular grains can be easily prepared by methods described in, e.g., Gutoff, "Photographic Science and Engineering", Vol. 14, PP. 248 to 257 (1970), U.S. Pat. Nos. 4,434,226, 4,414,310, 4,433,048, and 4,439,520, and British Patent 2,112,157.

In the present invention, a non-light-sensitive fine grain silver halide is preferably used. The non-light-sensitive fine grain silver halide means silver halide fine grains not sensitive upon imagewise exposure for obtaining a dye image and essentially not developed in development. The non-light-sensitive fine grain silver halide is preferably not fogged before hand.

The fine grain silver halide contains 0 to 100 mol % of silver bromide and may contain silver chloride and/or silver iodide as needed. Preferably, the fine grain silver halide contains 0.5 to 10 mol % of silver iodide.

An average grain size (an average value of equivalent-circle diameters of projected areas) of the fine grain silver halide is preferably 0.01 to 0.5 μm, and more preferably, 0.02 to 0.2 μm.

The fine grain silver halide can be prepared by a method similar to a method of preparing normal light-sensitive material silver halide. In this preparation, the surface of a silver halide grain need not be subjected to either chemical sensitization or spectral sensitization. However, before the silver halide grains are added to a coating solution, a known stabilizer such as a triazole compound, an azaindene compound, a benzothiazolium compound, a mercapto compound, or a zinc compound is preferably added. This fine grain silver halide grain containing layer preferably contains a colloidal silver.

A coating silver amount of the light-sensitive material of the present invention is preferably 7.0 g/m$^2$ or less, and most preferably, 6.0 g/m$^2$ or less.

Known photographic additives usable in the present invention are also described in the above three RDs, and they are summarized in the following Table 1:

TABLE 1

| Additives | RD17643 | RD18716 | RD307105 |
|---|---|---|---|
| 1. Chemical sensitizers | page 23 | page 648, right column | page 866 |
| 2. Sensitivity increasing agents | | page 648, right column | |
| 3. Spectral sensitizers, super sensitizers | pages 23–24 | page 648, right column to page 649, right column | pages 866 to 868 |
| 4. Brightners | page 24 | | page 868 |
| 5. Antifoggants and stabilizers | pages 24–25 | page 649, right column | pages 868 to 870 |
| 6. Light absorbent, filter dye, ultra-violet absorbents | pages 25–26 | page 649, right column to page 650, left column | page 873 |
| 7. Stain preventing agents | page 25, right column | page 650, left to right columns | page 872 |
| 8. Dye image stabilizer | page 25 | page 650, left column | page 872 |
| 9. Hardening agents | page 26 | page 651, left column | pages 874 to 875 |

TABLE 1-continued

| Additives | RD17643 | RD18716 | RD307105 |
|---|---|---|---|
| 10. Binder | page 26 | page 651, left column | pages 873 to 874 |
| 11. Plasticizers, lubricants | page 27 | page 650, right column | page 876 |
| 12. Coating aids, surface active agents | pages 26–27 | page 650, right column | pages 875 to 876 |
| 13. Antistatic agants | page 27 | page 650, right column | pages 876 to 877 |
| 14. Matting agent | | | pages 878 to 879 |

In order to prevent degradation in photographic properties caused by formaldehyde gas, a compound which can react with and fix formaldehyde described in U.S. Pat. No. 4,411,987 or 4,435,503 is preferably added to the light-sensitive material.

The light-sensitive material of the present invention preferably contains mercapto compounds described in U.S. Pat. Nos. 4,740,454 and 4,788,132, JP-A-62-18539, and JP-A-1-283551.

The light-sensitive material of the present invention preferably contains compounds for releasing a fogging agent, a development accelerator, a silver halide solvent, or precursors thereof described in JP-A-1-106052 regardless of a developed silver amount produced by the development.

The light-sensitive material of the present invention preferably contains dyes dispersed by methods described in WO 88/04794 and JP-A-1-502912 or dyes described in EP 317,308A, U.S. Pat. No. 4,420,555, and JP-A-1-259358.

Various color couplers can be used in the present invention, and specific examples of these couplers are described in patents described in above-mentioned Research Disclosure (RD), No. 17643, VII-C to VII-G and RD No. 307105, VII-C to VII-G.

Preferable examples of a yellow coupler are described in, e.g., U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023, and 4,511,649, and EP 249,473A.

Examples of a magnenta coupler are preferably 5-pyrazolone and pyrazoloazole compunds, and more preferrably, compounds described in, e.g., U.S. Pat. Nos. 4,310,619 and 4,351,897, EP 73,636, U.S. Pat. Nos. 3,061,432 and 3,725,067, Research Disclosure No. 24220 (June 1984), JP-A-60-33552, Research Disclosure No. 24230 (June 1984), JP-A-60-43659, JP-A-61-72238, JP-A-60-35730, JP-A-55-118034, and JP-A-60-185951, U.S. Pat. Nos. 4,500,630, 4,540,654, and 4,565,630, and WO No. 88/04795.

The other examples of a cyan coupler than that represented by the formula (I) are phenol and naphthol couplers, and preferably, those described in, e.g., U.S. Pat. Nos. 4,052,212, 4,146,396, 4,228,233, 4,296,200, 2,369,929, 2,801,171, 2,772,162, 2,895,826, 3,772,002, 3,758,308, 4,343,011, and 4,327,173, West German Application (OLS) 3,329,729, EP 121,365A and 249,453A, U.S. Pat. Nos. 3,446,622, 4,333,999, 4,775,616, 4,451,559, 4,427,767, 4,690,889, 4,254,212, and 4,296,199, and JP-A-61-42658.

Typical examples of a polymerized dye-forming coupler are described in U.S. Pat. Nos. 3,451,820, 4,080,221, 4,367,282, 4,409,320, and 4,576,910, British Patent 2,102,137, and EP 341,188A.

Preferable examples of a coupler capable of forming colored dyes having proper diffusibility are those described in U.S. Pat. No. 4,366,237, British Patent 2,125,570, EP 96,570, and West German Patent Application (OLS) No. 3,234,533.

Preferable examples of a colored coupler for correcting additional, undesirable absorption of a colored dye are those described in Research Disclosure No. 17643, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye re leased upon coupling described in U.S. Pat. No. 4,774,181 or a coupler having a dye precursor group which can react with a developing agent to form a dye as a split-off group described in U.S. Pat. No. 4,777,120 may be preferably used.

Couplers releasing a photographically useful residue upon coupling are preferably used in the present invention. DIR couplers, i.e., couplers releasing a development inhibitor are described in the patents cited in the above-described RD No. 17643, VII-F, RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

Preferable examples of a coupler for imagewise releasing a nucleating agent or a development accelerator when the light-sensitive material is developed are described in British Patents 2,097,140 and 2,131,188, JP-A-59-157638, and JP-A-59-170840. In addition, compounds for releasing a fogging agent, a development accelerator, or a silver halide solvent upon redox reaction with an oxidized form of a developing agent, described in JP-A-60-107029, JP-A-60-252340, JP-A-1-44940, and JP-A-1-45687, can also be preferably used.

Examples of a coupler which can be used in the light-sensitive material of the present invention are competing couplers described in, e.g., U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, e.g., JP-A-60-185950 and JP-A-62-24252; couplers releasing a dye which turns to a colored form after being released described in EP 173,302A and 313,308A; a legand releasing coupler described in, e.g., U.S. Pat. No. 4,553,477; a coupler releasing a leuco dye described in JP-A-63-75747; and a coupler releasing a fluorescent dye described in U.S. Pat. No. 4,774,181.

The yellow couplers and the magenta couplers for use in this invention can be added to the light-sensitive material by various known dispersion methods.

Examples of a high-boiling organic solvent to be used in the oil-in-water dispersion method are described in, for example, U.S. Pat. No. 2,322,027. Examples of a high-boiling organic solvent to be used in the oil-in-water dispersion method and having a boiling point of 175° C. or more at atmospheric pressure are those specified above. Also, another organic solvent having a boiling point of about 30° C. or more, preferably 50° to 160° C., can be used as auxiliary solvent. Typical examples of the auxiliary solvent are ethyl acetate, butyl acetate, ethyl propionate, methyl-ethyl ketone, cyclohexanone, 2-ethoxyethyl acetate, and dimethylform amide.

Steps and effects of a latex dispersion method and examples of a loadable latex are described in, e.g., U.S. Pat. No. 4,199,363 and German Patent Application (OLS) Nos. 2,541,274 and 2,541,230.

Various types of an antiseptic agent or a mildew proofing agent are preferably added to the color light-sensitive material of the present invention. Examples of the antiseptic agent and the mildewproofing agent are phenethyl alcohol; and 1,2-benzisothiazoline-3-one, n-butyl-p-hydroxybenzoate, phenol, 4-chloro-3,5-di methylphenol, 2-phenoxyethanol, and 2-(4-thiazolyl) benzimidazole described in JP-A-63-257747, JP-A-62-272248, and JP-A-1-80941.

The present invention can be applied to various color light-sensitive materials. Examples of the material are a color negative film for a general purpose or a movie, a color reversal film for a slide or a television, color paper, a color positive film, and color reversal paper.

A support which can be suitably used in the present invention is described in, e.g., RD. No. 17643, page 28, RD. No. 18716, from the right column, page 647 to the left column, page 648, and RD. No. 307105, page 879.

The light-sensitive material according to the invention has a film swell speed T1/2 which is preferably 30 sec. or less, and more preferably, 20 sec. or less. The film swell speed T1/2 can be measured in accordance with a known method in the art. For example, it can be measured by using a swell meter described in Photographic Science & Engineering, A. Green et al., Vol. 19, No. 2, pp. 124 to 129. When 90% of a maximum swell film thickness reached by performing a treatment by using a color developing agent at 30° C. for 3 min. and 15 sec. is defined as a saturated film thickness, T1/2 is defined as a time required for reaching ½ of the saturated film thickness.

The film swell speed T1/2 can be adjusted by adding a film hardening agent to gelatin as a binder or changing aging conditions after coating. A swell ratio is preferably 150% to 400%. The swell ratio is calculated from the maximum swell film thickness measured under the above conditions in accordance with a relation: (maximum swell film thickness—film thickness)/film thickness.

In the light-sensitive material of the present invention, hydrophilic colloid layers (called back layers) having a total dried film thickness of 2 to 20 μm are preferably formed on the side opposite to the side having emulsion layers.

The silver halide light-sensitive material of the invention can be used as thermal-developing light-sensitive materials of the type disclosed in U.S. Pat. No. 4,500,626, JP-A-60-133449, JP-A-59-218443, JP-A-61-238056, and European Patent 210,660A2.

The present invention will be described in more detail below by way of its examples, but the present invention is not limited to these examples.

EXAMPLE 1

A plurality of layers having the following compositions were coated on an undercoated triacetylcellulose film support, forming a multi-layer color light-sensitive material (hereinafter referred to as "Sample 101").

(Compositions of light-sensitive layers)

Numerals corresponding to each component indicates a coating amount represented in units of g/m$^2$. The coating amount of a silver halide is represented by the coating amount of silver. The coating amount of a sensitizing dye is represented in units of moles per mole of a silver halide in the same layer. (Sample 101)

| | |
|---|---|
| Layer 1: Antihalation layer | |
| Black colloidal silver | silver 0.18 |
| Gelatin | 1.40 |
| Layer 2: Interlayer | |
| 2,5-di-t-pentadecylhydroquinone | 0.18 |
| EX-1 | 0.070 |
| EX-3 | 0.020 |
| EX-12 | $2.0 \times 10^{-3}$ |
| U-1 | 0.060 |
| U-2 | 0.080 |
| U-3 | 0.10 |
| HBS-1 | 0.10 |
| HBS-2 | 0.020 |
| Gelatin | 1.04 |
| Layer 3: 1st red-sensitive emulsion layer | |
| Emulsion A | silver 0.25 |
| Emulsion B | silver 0.25 |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| EX-2 | 0.34 |
| EX-10 | 0.020 |
| U-1 | 0.070 |
| U-2 | 0.050 |
| U-3 | 0.070 |
| HBS-1 | 0.060 |
| Gelatin | 0.87 |
| Layer 4: 2nd red-sensitive emulsion layer | |
| Emulsion G | silver 1.00 |
| Sensitizing dye I | $5.1 \times 10^{-5}$ |
| Sensitizing dye II | $1.4 \times 10^{-5}$ |
| Sensitizing dye III | $2.3 \times 10^{-4}$ |
| EX-2 | 0.40 |
| Ex-3 | 0.050 |
| EX-10 | 0.015 |
| EX-13 | 0.045 |
| U-1 | 0.070 |
| U-2 | 0.050 |
| U-3 | 0.070 |
| Gelatin | 1.30 |
| Layer 5: 3rd red-sensitive emulsion layer | |
| Emulsion D | silver 1.60 |
| Sensitizing dye I | $5.4 \times 10^{-5}$ |
| Sensitizing dye II | $1.4 \times 10^{-5}$ |
| Sensitizing dye III | $2.4 \times 10^{-4}$ |
| EX-2 | 0.097 |
| EX-3 | 0.010 |
| EX-4 | 0.080 |
| HBS-1 | 0.035 |
| HBS-2 | 0.015 |
| Gelatin | 1.63 |
| Layer 6: Interlayer | |
| EX-5 | 0.040 |
| HBS-1 | 0.020 |
| Gelatin | 0.80 |
| Layer 7: 1st green-sensitive emulsion layer | |
| Emulsion A | silver 0.15 |
| Emulsion B | silver 0.15 |
| Sensitizing dye IV | $3.0 \times 10^{-5}$ |
| Sensitizing dye V | $1.0 \times 10^{-4}$ |
| Sensitizing dye VI | $3.8 \times 10^{-4}$ |
| EX-1 | 0.021 |
| EX-6 | 0.26 |
| Ex-7 | 0.030 |
| Ex-8 | 0.025 |
| HBS-1 | 0.10 |
| HBS-3 | 0.010 |
| Gelatin | 0.63 |
| Layer 8: 2nd green-sensitive emulsion layer | |
| Emulsion C | silver 0.45 |
| Sensitizing dye IV | $2.1 \times 10^{-5}$ |
| Sensitizing dye V | $7.0 \times 10^{-5}$ |
| Sensitizing dye VI | $2.6 \times 10^{-4}$ |
| EX-6 | 0.094 |
| Ex-7 | 0.026 |
| Ex-8 | 0.018 |
| HBS-1 | 0.16 |
| HBS-3 | $8.0 \times 10^{-3}$ |
| Gelatin | 0.50 |
| Layer 9: 3rd green-sensitive emulsion layer | |

-continued

| | |
|---|---|
| Emulsion E | silver 1.20 |
| Sensitizing dye IV | $3.5 \times 10^{-5}$ |
| Sensitizing dye V | $8.0 \times 10^{-5}$ |
| Sensitizing dye VI | $3.0 \times 10^{-4}$ |
| EX-1 | 0.025 |
| Ex-11 | 0.10 |
| Ex-14 | 0.015 |
| HBS-1 | 0.25 |
| HBS-2 | 0.10 |
| Gelatin | 1.54 |
| Layer 10: Yellow filter layer | |
| Yellow colloidal silver | silver 0.050 |
| EX-5 | 0.080 |
| HBS-1 | 0.030 |
| Gelatin | 0.95 |
| Layer 11: 1st blue-sensitive emulsion layer | |
| Emulsion A | silver 0.080 |
| Emulsion B | silver 0.070 |
| Emulsion F | silver 0.070 |
| Sensitizing dye VII | $3.5 \times 10^{-4}$ |
| EX-8 | 0.042 |
| Ex-9 | 0.72 |
| HBS-1 | 0.28 |
| Gelatin | 1.10 |
| Layer 12: 2nd blue-sensitive emulsion layer | |
| Emulsion J | silver 0.45 |
| Sensitizing dye VII | $2.1 \times 10^{-4}$ |
| Ex-9 | 0.15 |
| Ex-10 | $7.0 \times 10^{-3}$ |
| I-9 | $1.1 \times 10^{-5}$ |
| HBS-1 | 0.050 |
| Gelatin | 0.78 |
| Layer 13: 3rd blue-sensitive emulsion layer | |
| Emulsion H | silver 0.77 |

-continued

| | |
|---|---|
| Sensitizing dye VII | $2.2 \times 10^{-4}$ |
| EX-9 | 0.20 |
| HBS-1 | 0.070 |
| Gelatin | 0.69 |
| Layer 14: 1st protective layer | |
| Emulsion I | silver 0.20 |
| U-4 | 0.11 |
| U-5 | 0.17 |
| HBS-1 | $5.0 \times 10^{-2}$ |
| Gelatin | 1.00 |
| Layer 15: 2nd protective layer | |
| H-1 | 0.40 |
| B-1 (diameter: 1.7μ) | $5.0 \times 10^{-2}$ |
| B-2 (diameter: 1.7μ) | 0.10 |
| B-3 | 0.10 |
| S-1 | 0.20 |
| Gelatin | 1.20 |

Further, all layers of Sample 1 contained W-1, W-2, W-3, B-4, B-5, F-1, F-2, F-3, F-4, F-5, F-6, F-7, F-8, F-9, F-10, F-11, F-12, F-13, iron salt, lead salt, gold salt, platinum salt, iridium salt, and rohdium salt, so that they may have improved storage stability, may be more readily processed, may be more resistant to pressure, more antibacterial and more antifungal, may be better protected against electrical charging, and may be more readily coated. The particulars of Emusions A to J used will be shown in Table 2, and the compounds used will be specified by the following formulas.

TABLE 2

| | Average AgI Content (%) | Average Grain Size (μm) | Variation Coefficient (%) According to Grain Size (%) | Diameter-to-Thickness Ratio | Silver Amount Ratio (AgI Content, %) |
|---|---|---|---|---|---|
| Emulsion A | 4.0 | 0.45 | 27 | 1 | Core/shell = 1/3(13/1), Double structure regular-crystal grain |
| Emulsion B | 8.9 | 0.70 | 14 | 1 | Core/shell = 3/7(25/2), Double structure regular-crystal grain |
| Emulsion C | 10 | 0.75 | 30 | 2 | Core/shell = 1/2(24/3), Double structure grain |
| Emulsion D | 16 | 1.05 | 35 | 2 | Core/shell = 4/6(40/0), Double structure grain |
| Emulsion E | 10 | 0.9 | 35 | 5 | Core/shell = 1/2(24/3), Double structure grain |
| Emulsion F | 4.0 | 0.25 | 28 | 1 | Core/shell = 1/3(13/1), Double structure regular-crystal grain |
| Emulsion G | 14.0 | 0.75 | 25 | 2 | Core/shell = 1/2(42/0), Double structure grain |
| Emulsion H | 14.5 | 1.30 | 25 | 3 | Core/shell = 37/03(34/3), Double structure grain |
| Emulsion I | 1 | 0.07 | 15 | 1 | Uniform grain |
| Emulsion J | 5.0 | 0.63 | 20 | 6 | Core/shell = 1/1(8/2), Double structure regular-crystal grain (80%) of total projected area occupied by grains having aspect ratios of 3 or more) |
| Emulsion K | 5.0 | 0.60 | 18 | 2 | Core/shell = 1/1(8/2), Double structure grain |
| Emulsion L | 14.5 | 1.21 | 23 | 2 | Core/shell = 37/63(34/3), Double structure grain |
| Emulsion M | 5.0 | 0.63 | 20 | 5.8 | Grain having dislocation at fringe (70% of total projected area occupied by grains having aspect ratios of 3 or more |

EX-1
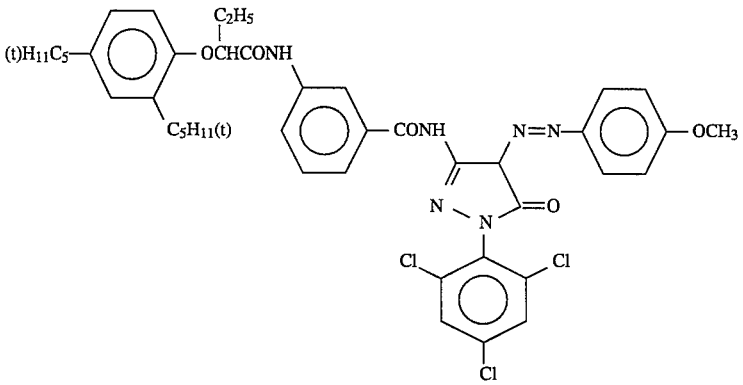
EX-2
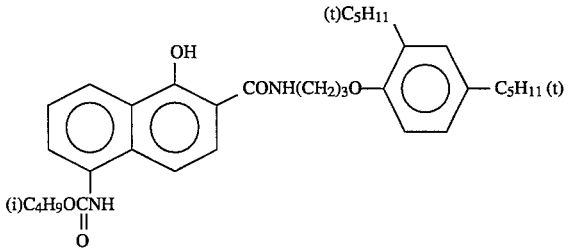
EX-3
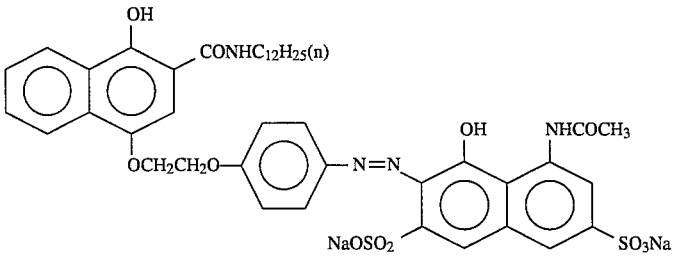
EX-4
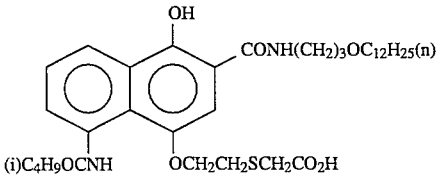
EX-5
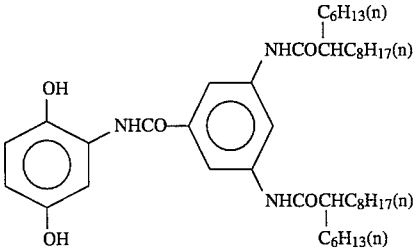

-continued
EX-6
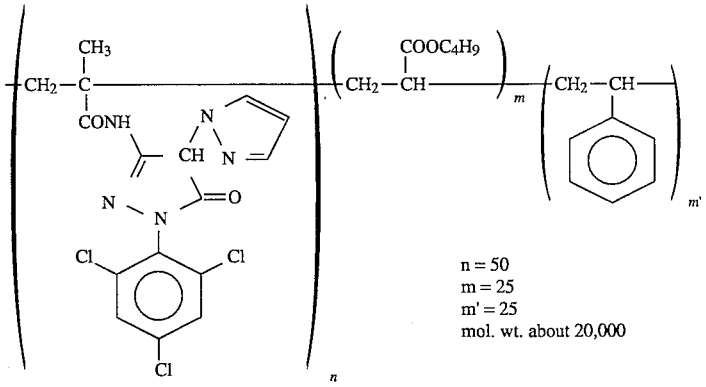
EX-7
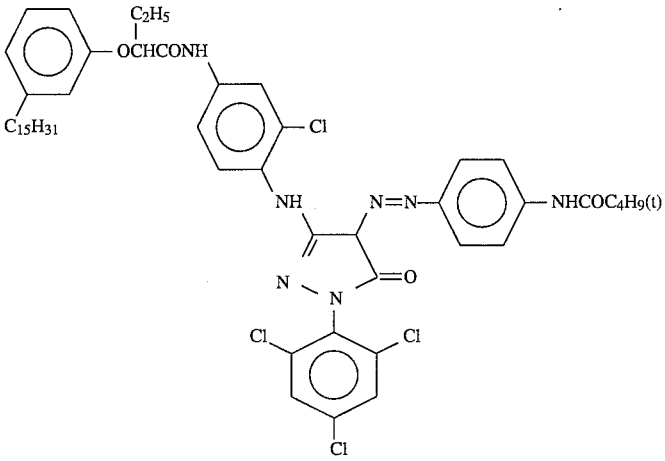
EX-8
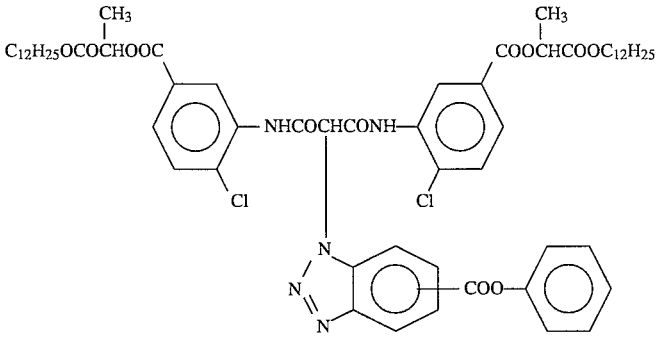

-continued
EX-9
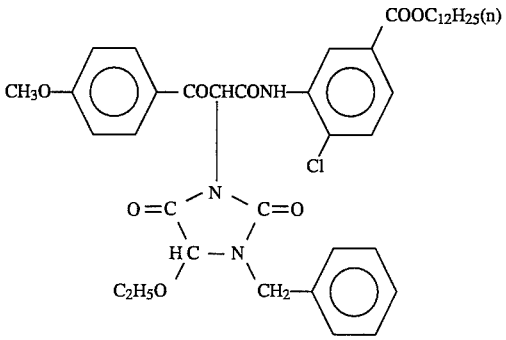
EX-10
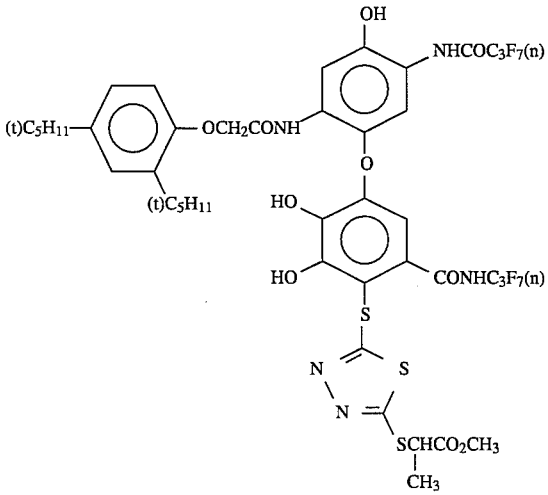
EX-11
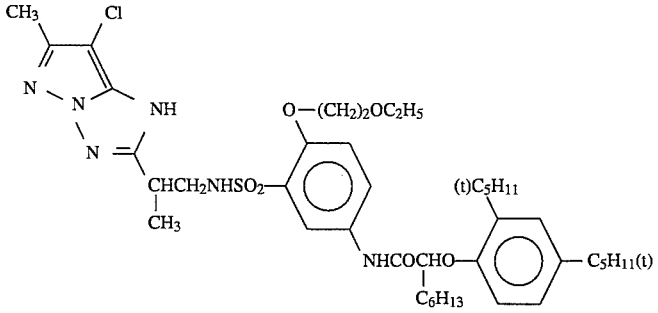
EX-12
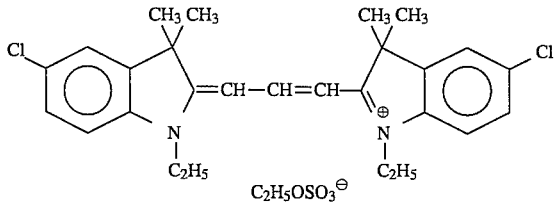

-continued
EX-13
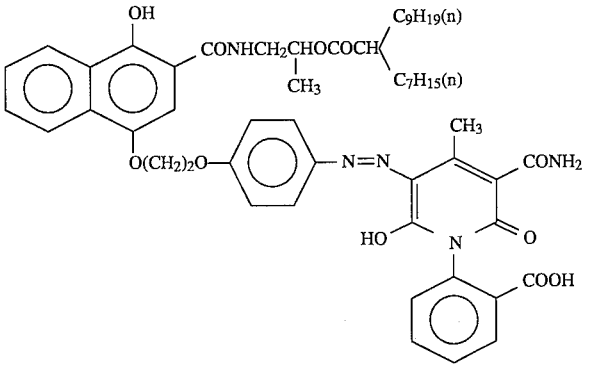
EX-14
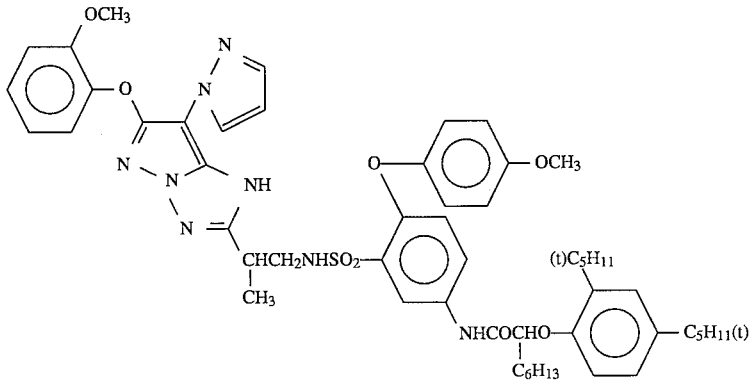
U-1
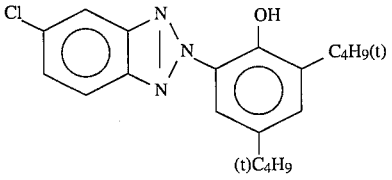
U-2
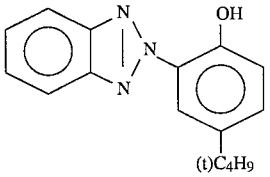
U-3
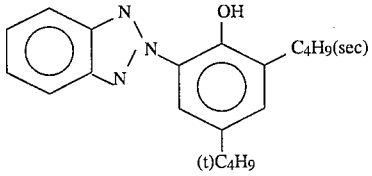

-continued
U-4
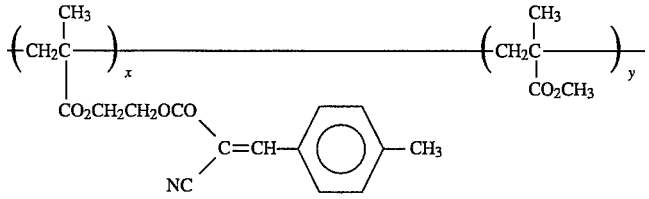
U-5
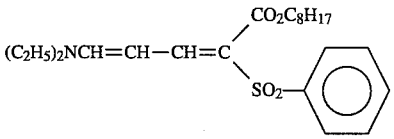
HBS-1
Tricresylphosphate
HBS-2
Di-n-butylphthalate
HBS-3
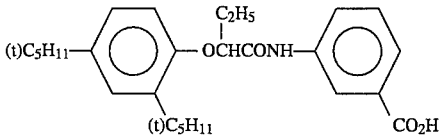
sensitizing dye I
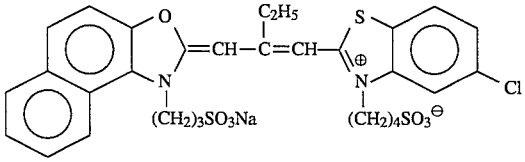
sensitizing dye II
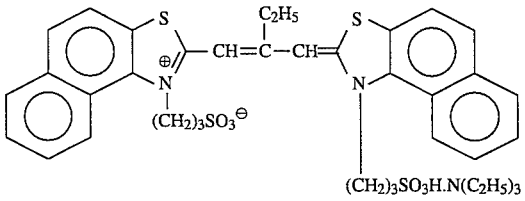
sensitizing dye III
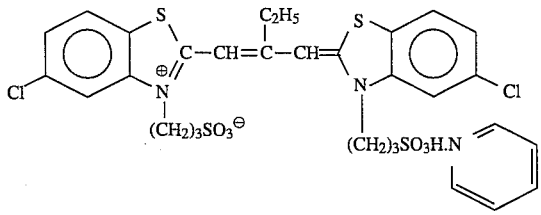

-continued
sensitizing dye IV
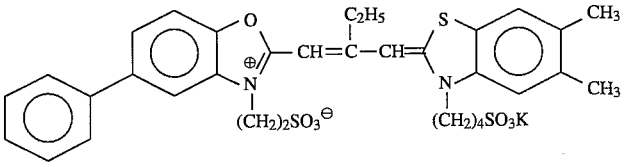
sensitizing dye V
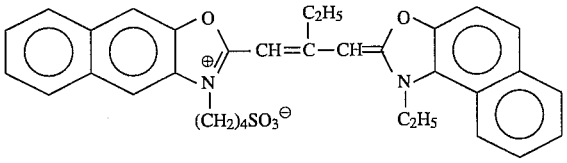
sensitizing dye VI
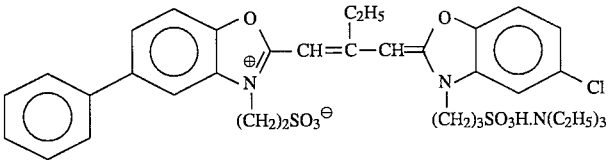
sensitizing dye VII
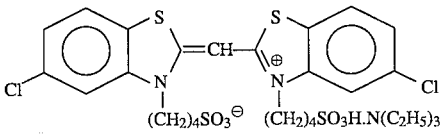
S-1
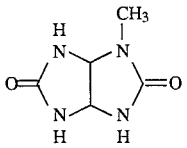
H-1
$CH_2{=}CH{-}SO_2{-}CH_2{-}CONH{-}CH_2$
$CH_2{=}CH{-}SO_2{-}CH_2{-}CONH{-}CH_2$
B-1
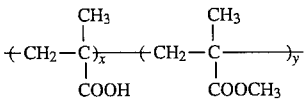
x/y = 10/90
B-2
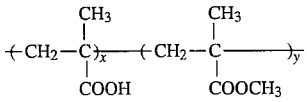
x/y = 40/60

-continued
B-3
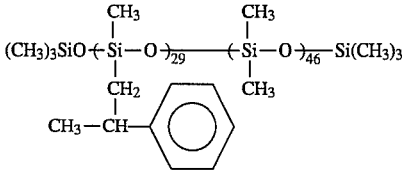
B-4
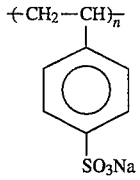
B-5
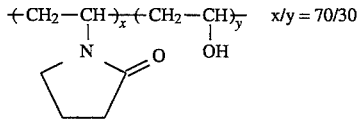
x/y = 70/30
W-1
$C_8F_{17}SO_2NHCH_2CH_2CH_2OCH_2CH_2\overset{\oplus}{N}(CH_3)_3$
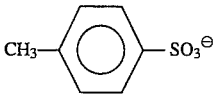
W-2
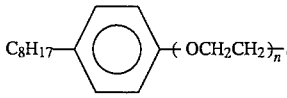
n = 2 to 4
W-3
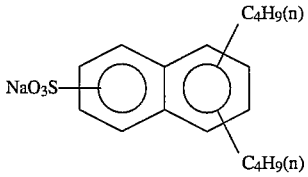
F-1
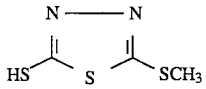

-continued
F-2
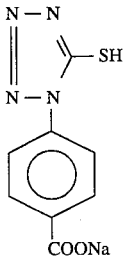
F-3
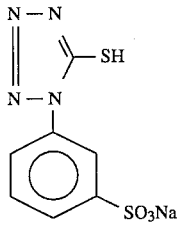
F-4
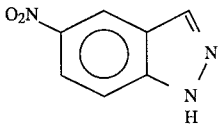
F-5
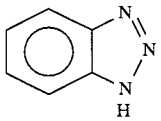
F-6
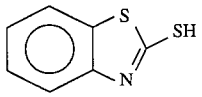
F-7
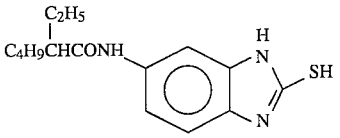
F-8
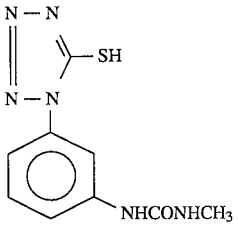
F-9
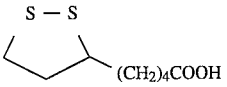

F-10
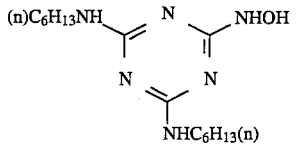
F-11
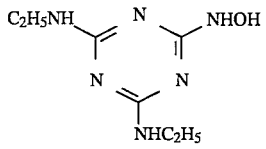
F-12
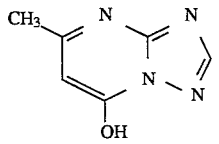
F-13
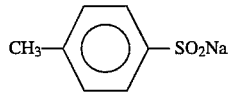
(Sample 102)
Sample 102 was prepared in the same way as Sample 101, except that sensitizing dyes VIII and IX, specified below, were contained in the layer 9, replacing the sensitizing dyes V and V, respectively.
Sensitizing dye VIII
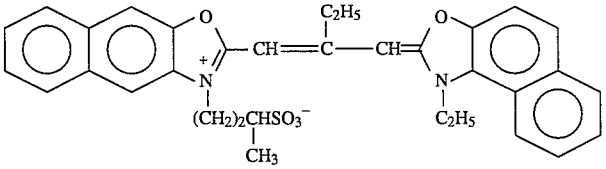
Sensitizing dye IX
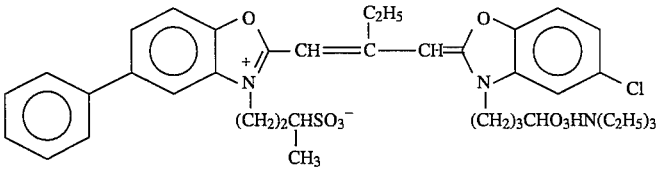

(Sample 103)

Sample 103 was prepared in the same way as Sample 102, except that sensitizing dyes VIII and IX were contained in the layers 7 and 8, replacing the sensitizing dyes V and VI, respectively.

(Sample 104)

Sample 104 was prepared in the same way as Sample 103, except that the amount of gelatin used in every layer was increased 1.4 times.

(Sample 105)

Sample 105 was prepared in the same way as Sample 103, except that the amount of gelatin used in every layer was increased 0.85 times.

Samples 101 to 105, thus prepared, were left to stand for 14 hours at 40° C. and relative humidity of 70%. Thereafter, they were subjected to wedge exposure using white light. Next, these samples were developed by the mentod specified below.

Processing Method

Processing Method

| Process | Time | Temp. | Replenish Amount* | Tank volume |
|---|---|---|---|---|
| Color development | 2 min. 45 sec. | 38° C. | 3 ml | 20 l |
| Bleaching | 6 min. 30 sec. | 38° C. | 25 ml | 40 l |
| Washing | 2 min. 10 sec. | 24° C. | 1200 ml | 20 l |
| Fixing | 4 min. 20 sec. | 38° C. | 25 ml | 30 l |
| Washing (1) | 1 min. 05 sec. | 24° C. | ** | 10 l |
| Washing (2) | 1 min. 00 sec. | 24° C. | 1200 ml | 10 l |
| Stabilization | 1 min. 05 sec. | 38° C. | 25 ml | 10 l |
| Drying | 4 min. 20 sec. | 55° C. | | |

*Replenishing amount per meter of a 35-mm wide sample
**Counter flow from the step (2) to the step (1)

The compositions of the solutions used in the color-developing process are as follows:

| | Mother Solution (g) | Replenishment Solution (g) |
|---|---|---|
| (Color Developing Solution) | | |
| Diethylenetriamine-pentaacete | 1.0 | 1.1 |
| 1-hydroxyethylidine-1,-diphosphonic acid | 3.0 | 3.2 |
| Sodium sulfide | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-[N-ethyl-N-β-hydroxylethylamino]-2-methylaniline sulfate | 4.5 | 5.5 |
| Water to make | 1.0 l | 1.0 l |
| pH | 10.05 | 10.10 |
| (Bleaching Solution) | | |
| Sodium ferric ethylenediamine tetra-acetate trihydrate | 10.0 | 11.0 |
| Disodium ethylene-diamine tetraacetate | 10.0 | 11.0 |
| Ammonium bromide | 140.0 | 160.0 |
| Ammonium nitrate | 30.0 | 35.0 |
| Ammonia water (27%) | 6.5 ml | 4.0 ml |
| Water to make | 1.0 l | 1.0 l |
| pH | 6.0 | 5.7 |
| (Fixing Solution) | | |
| Disodium ethylene diamine tetra-aacete | 0.5 | 0.7 |
| Sodium sulfite | 7.0 | 8.0 |
| Sodium bissulfite | 5.0 | 5.5 |
| Ammonium thiosulfate aqueous solution (700 g/l) | 170.0 ml | 200.0 ml |
| Water to make | 1.0 l | 1.0 l |
| pH | 6.7 | 6.6 |
| (Stabilizing Solution) | | |
| Formalin (37%) | 2.0 ml | 3.0 ml |
| Polyoxyethylene-p-mononyl phenyl ether (Average polymerization degree: 10) | 0.3 | 0.45 |
| Disodium ethylene-diamine tetra-acetate | 0.05 | 0.08 |
| Water to make | 1.0 l | 1.0 l |
| pH | 5.0 to 8.0 | 5.0 to 8.0 |

Samples 101 to 105 were also subjected to pressure-resistance test. In the test, the samples were left to stand for 3 hours in an atmosphere having relative humidity of 55%. Next, in this atmosphere, a stylus having a diameter of 0.1 mm was moved at 1 cm/sec on the surface of each sample, while applying a load of 4 g thereto, thereby scratching the top emulsion layer. Samples 101 to 105, thus scratched, were developed, and their densities were measured by means of a 25 μmϕ aperture.

The sharpness of each sample was evaluated in terms of MTF value thereof. The MTF values of Samples 101 to 105 were measured by the method disclosed in "Journal of Applied Photographic Engineering," Vol. 6(1)1–8, 1980. The MTF value of Sample 101 was taken as 100 for a reference, while those of Samples 102 to 105 were relative to that reference value.

The results of the test were as is shown in the following Table 3.

TABLE 3

| Sample | Specific Sensitivity | Thickness Measured from Layer 3 to Layer 15 | Sentizing Dye Layers 7 and 8 | Sentizing Dye Layers 9 | Sensitivity of Green-Sensitive Layer | Fog Increase Due to Scratching (Magenta) | MTF Value of Cyan Image (25 lines/mm) |
|---|---|---|---|---|---|---|---|
| 101 | 410 | 18.5 μm | V | V | 100 | 0.35 | 100 |
| Comp. | | | VI | VI | | | |
| 102 | 410 | 18.5 μm | V | VIII | 100 | 0.20 | 100 |
| Invention | | | VI | IX | | | |
| 103 | 410 | 18.5 μm | VIII | VIII | 100 | 0.15 | 100 |
| Invention | | | IX | IX | | | |
| 104 | 405 | 23 μm | VIII | VIII | 98 | 0.12 | 85 |
| Comp. | | | IX | IX | | | |
| 105 | 415 | 17 μm | VIII | VIII | 100 | 0.18 | 100 |
| Invention | | | IX | IX | | | |

Dyes V and VI fall outside the scope of the present invention. Dyes VIII and IX are used in this invention.

As is evident from Table 3, Samples 102, 103, and 105, which fall within the scope of the invention, exhibited good sharpness and had less friction fog. As can be understood from Table 3, too, if the film thickness is 23 μm, the material will have high pressure resistance but will have its sharpness decreased.

EXAMPLE

Samples 106 to 112 were prepared, as will be detailed below.

(Sample 106) Sample 106 was prepared in the same way as Sample 101, except that sensitizing dye X identified by the following formula was contained in the layer 13, re placing the sensitizing dye VII.

Sensitizing dye X

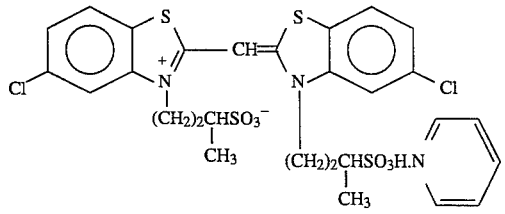

(Sample 107)

Sample 107 was prepared in the same way as Sample 106 except that sensitizing dye X was contained in the layers 11 and 12, replacing the sensitizing dye VII.

(Sample 108)

Sample 108 was prepared in the same way as Sample 107 except that the layers 14 and 15 contained less gelatin, and had a total thickness of 1.5 μm less than that of their counterparts of Sample 107.

(Sample 109)

Sample 109 was prepared in the same way as Sample 107 except that the layers 14 and 15 contained more gelatin, and had a total thickness of 3.5 μm greater than that of their counterparts of Sample 107.

(Sample 110)

Sample 110 was prepared which was identical to Sample 107, except that the layer 12 contained emulsion K, not emulsion J.

(Sample 111)

Sample 111 was prepared which was identical to Sample 110, except that the layer 13 contained emulsion L, not emulsion H.

(Sample 112)

Sample 112 was prepared which was identical to Sample 107, except that the layer 12 contained emulsion M, not emulsion J.

Samples 106 to 112, thus prepared were exposed, developed, and tested, exactly in the same way as Samples 101 to 105. The results of the test were as is represented in the following Table 4:

TABLE 4

| Sample | Specific Sensitivity | Total Thickness of Layer 14 | Sentizing Dye Layers 11 and 12 | Sentizing Dye Layers 13 | Sensitivity of Blue-Sensitive Layer | Fog Increase Due to Scratching (Yellow) | MTF Value of Cyan Image (25 lines/mm) |
|---|---|---|---|---|---|---|---|
| 101 | 410 | 2.8 μm | VII | VII | 100 | 0.40 | 100 |
| Comp. 106 | 410 | 2.8 μm | VII | X | 100 | 0.30 | 100 |
| Invention 107 | 410 | 2.8 μm | X | X | 100 | 0.25 | 100 |
| Invention 108 | 410 | 2.8 μm | X | X | 100 | 0.30 | 110 |
| Invention 109 | 410 | 2.8 μm | X | X | 100 | 0.20 | 85 |
| Comp. 110 | 410 | 2.8 μm | X | X | 100 | 0.21 | 93 |
| Invention 111 | 410 | 2.8 μm | X | X | 100 | 0.19 | 91 |
| Invention 112 | 410 | 2.8 μm | X | X | 100 | 0.23 | 98 |
| Invention | | | | | | | |

Dye VIII falls outside the scope of the present invention, and dye X is one used in this invention.

As can be seen from Table 4, the thicker the layers 14 and 15, the less sharpness. Nonetheless, the use of the compound of the invention will increase the sharpness, without reducing the pressure resistance.

Further, tabular grains, if contained in any blue-sensitive layer, will help to improve the sharpness of the light-sensitive material.

EXAMPLE 3

Samples 113 to 116 were prepared, as will be de scribed in detail.

(Sample 113)

Sample 113 was prepared in the same way as Sample 101, except that sensitizing dyes XI and XII identified by the following formulas were contained in the layer 5, replacing sensitizing dyes I and III, respectively.

Sensitizing dye XI

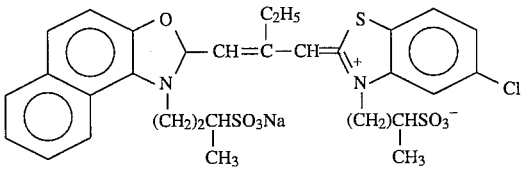

Sensitizing dye XII

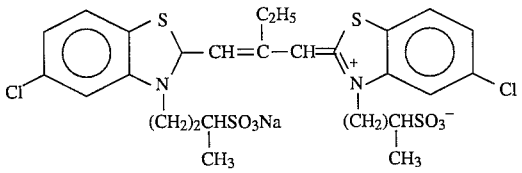

(Sample 114)

Sample 114 was prepared in the same way as Sample 113, except that an emulsion dispersant was coated, thereby doubling the amounts of HBS-1 and HBS-2 contained in the layer 5.

(Sample 115)

Sample 115 was prepared in the same method as Sample 113, except that the cyan coupler represented by the following formula was used in place of EX-2 and EX-4.

Sensitizing dye XII

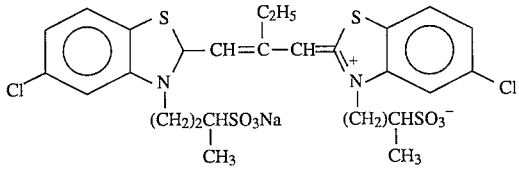

(Sample 116)

Sample 116 was prepared by the same method as Sample 114, except that sensitizing dyes I and III were used in place of dyes XI and XII, respectively.

Samples 113 to 116, thus prepared were exposed, developed, and tested, exactly in the same way as Samples 101 to 105. The results of the test were as is represented in the following Table 5.

Also, another set of Samples 113 to 116 were exposed to white light (2CMS. 1/100 second) and developed. The cyan-coloring densities of these samples were measured, relative to the cyan-coloring density of Sample 101 which was 100 and used as reference value. Their cyan-coloring densities are specified also in Table 5.

TABLE 5

| Sample | Sensitizing Dye in Layer 5 | Cyan Coupler in layer 5 (Solvent/ Coupler) | Sensitivity of Red-Sensitive Layer | Fog Increase Due to Scratching (Cyan) | MRF Value of Cyan Image (25 lines/mm) | Cyan-Coloring Density |
|---|---|---|---|---|---|---|
| 101 | I | EX-2, EX-4 | 100 | 0.12 | 100 | 100 |
| Comp. | III | (0.282) | | | | |
| 113 | XI | EX-2, EX-4 | 100 | 0.06 | 100 | 100 |
| Invention | XII | (0.282) | | | | |
| 114 | XI | EX-2, EX-4 | 101 | 0.05 | 93 | 100 |
| Invention | XII | (0.282) | | | | |
| 115 | XI | Comp. | 99 | 0.06 | 100 | 90 |
| Invention | XII | Compound (1) | | | | |
| 116 | I | EX-2, EX-4 | 101 | 0.09 | 93 | 100 |
| Comp. | III | (0.564) | | | | |

Dyes I and III fall outside the scope of the present invention, and dyes XI and XII are used in this invention.

As is evident from Table 5, the sharpness can be improved by reducing the amount of the high-boiling organic solvent. However, the smaller the amount of the solvent, the more prominent the fog. Nonetheless, the use of the compound falling within the scope of the invention decrease the fog, thus serving to provide a silver halide color photographic light-sensitive material which has high pressure resistance and can form high-quality images. From Table 5 it can also be understood that a naphthol-series cyan coupler having amide group at position 5 is suitable for use in the present invention.

As has been described above, the present invention can provide a silver halide color photographic light-sensitive material which has high pressure resistance and can form high-quality images.

What is claimed is:

1. A silver halide color photographic light-sensitive material having a specific photographic sensitivity of 320 or more, and comprising:

a support layer; and silver halide emulsion layers formed on the support layer, one upon or above another, including at least one red-sensitive layer, at least one green-sensitive layer, and at least one blue-sensitive layer, which have a total film thickness for all of said silver halide emulsion layers of 22 μm or less, measured from the light-sensitive layer closest to the support layer up to the surface of the material facing away from the support layer, and in which at least one of the silver halide emulsion layers contains a spectral sensitizer represented by the following formula (I):

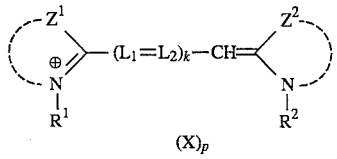

Formula (I)

wherein $R^1$ and $R^2$ are alkyl groups, in at least one of said alkyl groups at least one carbon atom bonds together with at least three atoms other than hydrogen atoms, $Z^1$ and $Z^2$ are groups of atoms forming a 5- or 6-membered nitrogen containing heterocyclic ring, k is 0, 1 or 2, X is an anion, p is 0 or 1, and $L_1$ and $L_2$ are a methyne group or a substituted methyne group.

2. A silver halide color photographic light-sensitive material having a specific photographic sensitivity of 320 or more, and comprising:

a support layer; and silver halide emulsion layers formed on the support layer, one upon or above another, including at least one red-sensitive layer, at least one green-sensitive layer, and at least one blue-sensitive layer, which has a protective layer located farther from the support layer than the light-sensitive layer located farther from the support layer than any other light-sensitive layer and having a thickness of 3 μm or less, and in which at least one of the silver halide emulsion layers contains a spectral sensitizer represented by the formula (I):

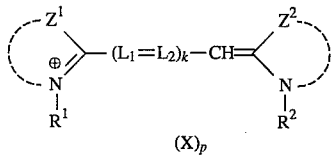

Formula (I)

wherein $R^1$ and $R^2$ are alkyl groups., in at least one of said alkyl groups at least one carbon atom bonds together with at least three atoms other than hydrogen atoms, $Z^1$ and $Z^2$ are groups of atoms forming a 5- or 6-membered nitrogen-containing heterocyclic ring, k is 0, 1, or 2, X is an anion, p is 0 or 1, $L_1$ and $L_2$ are a methyne group or a substituted methyne group.

3. The material according to claim 2, wherein said at least one blue-sensitive layer contains tabular grains having aspect ratios of at least 3, which occupy 50% or more of a total projected area of silver halide grains contained in said at least one blue-sensitive layer.

4. A silver halide color photographic light-sensitive material comprising:

a support layer; and silver halide emulsion layers formed on the support layer, one upon or above another, including at least one layer containing cyan couplers, at least one layer containing magenta couplers, and at least one layer containing yellow couplers, wherein said at least one layer containing cyan couplers also contains a spectral sensitizer represented by the formula (I):

Formula (I)

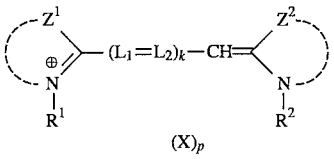

wherein $R^1$ and $R^2$ are alkyl groups, in at least one of said alkyl groups at least one carbon atom bonds together with at least three atoms other than hydrogen atoms, $Z^1$ and $Z^2$ are groups of atoms forming a 5- or 6-membered nitrogen-containing heterocyclic ring, k is 0, 1 or 2, X is an anion, p is 0 or 1, $L_1$ and $L_2$ are a methyne group or a substituted methyne group, and an organic solvent having a high boiling point, wherein the weight ratio of organic solvent to all cyan couplers used is at most 0.3, and at least one of the cyan couplers is one represented by the following formula (II):

Formula (II)

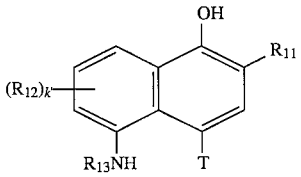

wherein $R_{11}$ is a halogen atom, aliphatic group, aromatic group, a heterocyclic group, amidino group, a guanidino group, or a group represented by $—CO_2R_{14}$, $—SOR_{14}$, $—P(=O)R_{14}R_{15}$, $—NHCOR_{14}$, $—NHSO_2R_{14}$, $—NHSOR_{14}$ or $—NHP(=O)R_{14}R_{15}$, $R_{12}$ is a halogen atom, a hydroxyl group, a carboxyl group, a sulfo group, an amino group, a cyano group, a nitro group, an aliphatic group, an aromatic group, a carbonamide group, a sulfonamide group, a carbamoyl group, a sulfamoyl group, a ureido group, an acyl group, an acyloxy group, an aliphatic oxy group, an aromatic oxy group, an aliphatic sulfonyl group, an aromatic sulfonyl group, an aliphatic sulfinyl group, an aromatic sulfinyl group, an aliphatic oxycarbonyl group, an aromatic oxycarbonyl group, an aliphatic oxycarbonylamino group, an aromatic oxycarbonylamino group, a sulfamoylamino group, a heterocyclic group, or an imido group, k' is an integer ranging from 0 to 3, and $R_{13}$ is a hydrogen atom or $R_{16}U$, T is a hydrogen atom or a group which can be released when it undergoes a coupling reaction with an aromatic primary amine developing oxide, said $R_{14}$ and $R_{15}$ are each an aliphatic group, an aromatic group, a heterocyclic group, an amino group, an aliphatic oxy group, or an aromatic oxy group, said $R_{16}$ is a hydrogen atom, an aliphatic group, an aromatic group, a heterocyclic group, $—OR_{17}$, $—SR_{17}$, $—COR_{18}$, $ON(R_{19})(R_{20})$, $—PO(R_{17})_2$, $—PO(—OP_{17})_2$, $—PO(—N(R_{19})(R_{20}))_2$, $—SO_2N(R_{19})(R_{20})$, $—CO_2R_{17}$, $—SO_2R_{17}$, $—SO_2OR_{17}$, or an imido group, said U is $—N(R_{10})—$, —CO—, $—SO_2—$, —SO—, or a single bond, said $R_{17}$ is an aliphatic group, an aromatic group, a heterocyclic group, said $R_{18}$ is a hydrogen atom, an aliphatic group, an aromatic group, or a heterocyclic group, said $R_{19}$ and $R_{10}$ are each independently a hydrogen atom, an aliphatic group, an aromatic group, a heterocyclic group, an acyl group, an aliphatic sulfonyl group, or an aromatic sulfonyl group, said groups $R_{12}$ are identical or different, or bond together, forming a ring, when k' is 2 or greater, said $R_{12}$ and $R_{13}$, or $R_{13}$ and T are able to bond together, forming a ring, and dimers or polymers (including oligomers) are formed at $R_{11}$, $R_{12}$, $R_{13}$, or T and are attached to one another through bivalent or polyvalent groups.

5. The material according to claim 1, wherein said emulsion layers have a total film thickness of 13 to 22 μm.

6. The material according to claim 1, wherein said emulsion layers have a total film thickness of 15 to 21 μm.

7. The material according to claim 1, wherein at least one of $R^1$ and $R^2$ is represented by the following formula (III):

Formula (III)

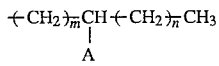

wherein A is an organic acid group, m is an integer ranging from 0 to 5, and n is an integer also ranging from 0 to 5.

8. The material according to claim 7, wherein m is 2 or 3, n is 0 or 1, and A is a sulfo group.

9. The material according to claim 8, wherein m is 2, and n is 0.

10. The material according to claim 1, wherein the silver content of the emulsion layers in said material, when added together, is in the range of 3.0 to 8.0 $g/m^2$.

11. The material according to claim 2, which further comprises a protective layer having a thickness of 0.5 to 3 μm.

12. The material according to claim 2, wherein said emulsion layers contain tabular grains having aspect ratios of 3 or more but less than 100, which occupy 50% or more of a total projected area of silver halide grains contained in said emulsion layer.

13. The material according to claim 2, wherein said emulsion layers contain tabular grains having aspect ratios of 3 or more but less than 20.

14. The material according to claim 1, wherein $R^1$ and $R^2$ are alkyl groups having 1 to 18 carbon atoms.

15. The material according to claim 1, wherein compound (I) is selected from the group consisting of I-1 to I-19 compounds:

I-1
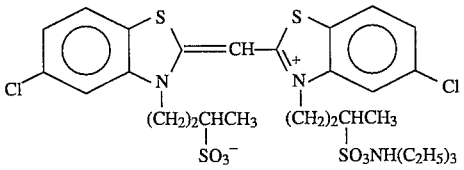
I-2
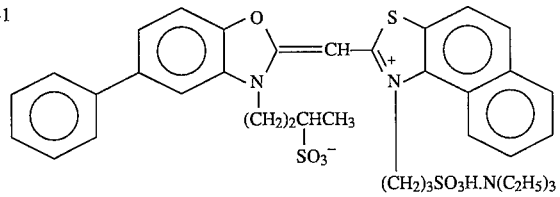
I-3
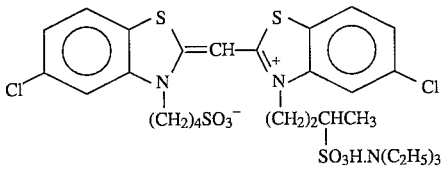
I-4
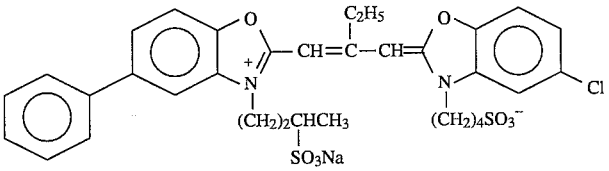
I-5
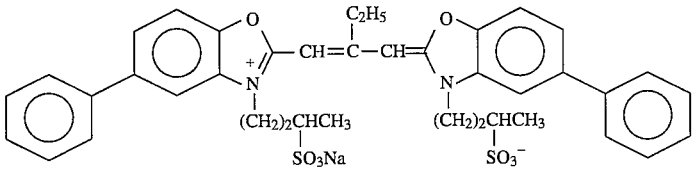
I-6
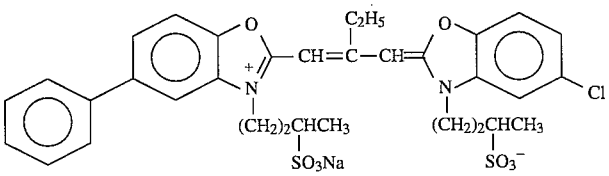
I-7
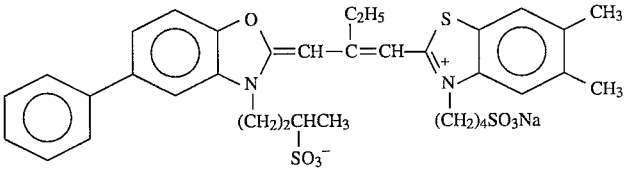
I-8
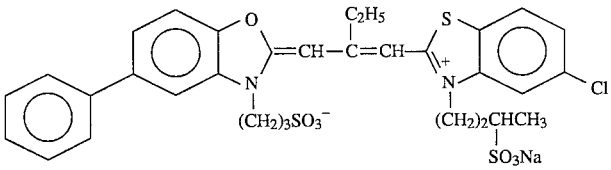
I-9
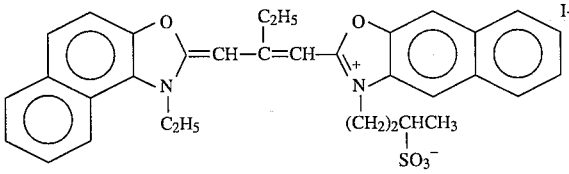
I-10
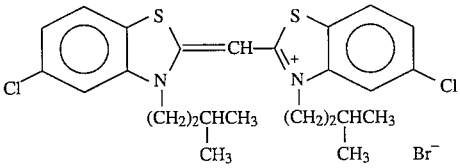
I-11
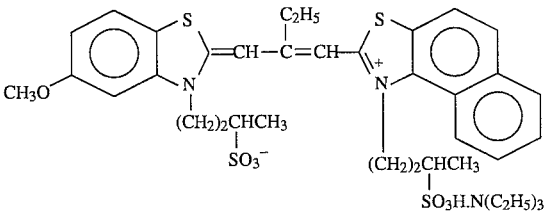
I-12
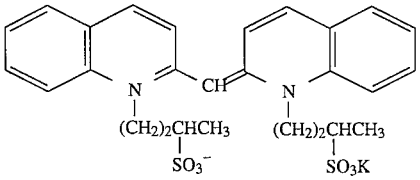

I-13

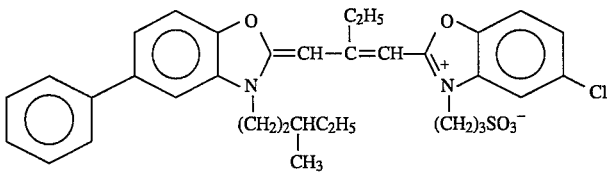

I-14

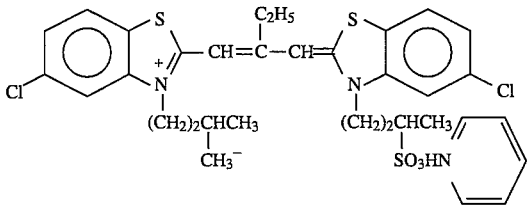

I-15

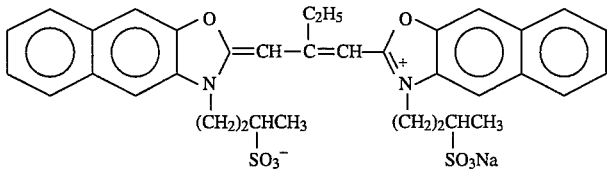

I-16

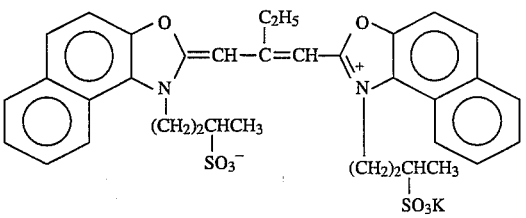

I-17

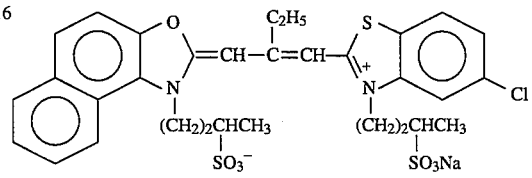

I-18

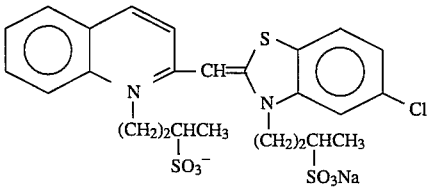

I-19

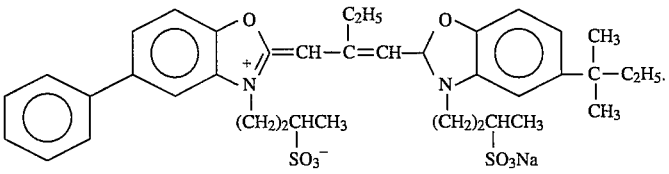

16. The material according to claim 1, wherein the spectral sensitizer of formula (I) is present in an amount of 40% to 100% of its saturated adsorption amount.

17. The material according to claim 4, wherein the amount of cyan coupler of formula (II) is $1.0\times10^{-5}$ to $3.0\times10^{-3}$ mol/m$^2$.

18. The material according to claim 1, wherein said compound of formula (I) is present in the green sensitive layer.

19. The material according to claim 2, wherein the amount of spectral sensitizer dye of formula (I) added to the grain is 40% to 60% of the amount of the dye that is required to cover the entire surface of the grain.

* * * * *